US005681092A

United States Patent [19]

Hanson et al.

[11] Patent Number: 5,681,092

[45] Date of Patent: Oct. 28, 1997

[54] ANATOMICAL WHEELCHAIR SEAT CUSHION SYSTEM

[76] Inventors: Denny Hanson, 7046 Indian Peaks Trail; Chris A. Hanson, 4563 S. Meadow Dr., both of Boulder, Colo. 80301

[21] Appl. No.: 335,932

[22] Filed: Nov. 8, 1994

[51] Int. Cl.[6] ..... A47C 7/02

[52] U.S. Cl. ..... 297/452.41; 297/452.21; 297/452.22; 297/452.23; 297/452.4; 297/284.9; 5/653; 5/657

[58] Field of Search ..... 297/452.41, 284.1, 297/284.3, 284.9, 195.11, 201, 452.21, 452.22, 452.23, 452.25, 452.26, 452.28, 452.4, DIG. 1, DIG. 4; 5/653, 654, 657, 465

[56] References Cited

U.S. PATENT DOCUMENTS

| | | | |
|---|---|---|---|
| 2,156,629 | 5/1939 | Hutchison | 155/182 |
| 2,260,437 | 10/1941 | Chambers | 155/182 |
| 3,308,491 | 3/1967 | Spence | 5/348 |
| 3,503,649 | 3/1970 | Johnson | 297/459 |
| 3,787,908 | 1/1974 | Beck et al. | 5/348 |
| 3,987,507 | 10/1976 | Hall | 5/338 |
| 4,370,769 | 2/1983 | Herzig et al. | 5/452 |
| 4,588,229 | 5/1986 | Jay | 297/459 |
| 4,643,481 | 2/1987 | Saloff et al. | 297/458 |
| 4,655,505 | 4/1987 | Kashiwamura et al. | 297/284 |
| 4,670,925 | 6/1987 | Carussi | 5/481 |
| 4,726,086 | 2/1988 | McEvoy | 5/464 |
| 4,726,624 | 2/1988 | Jay | 297/459 |
| 4,912,788 | 4/1990 | Lonardo | 5/432 |
| 5,018,790 | 5/1991 | Jay | 297/458 |
| 5,088,747 | 2/1992 | Morrison et al. | 297/219 |
| 5,189,747 | 3/1993 | Mundy et al. | 5/654 |
| 5,333,921 | 8/1994 | Dinsmoor, III | 297/219.1 |
| 5,343,876 | 9/1994 | Rogers | 128/870 |
| 5,378,045 | 1/1995 | Siekman et al. | 297/452.25 |

*Primary Examiner*—Laurie K. Cranmer
*Attorney, Agent, or Firm*—Sheridan Ross P.C.

[57] ABSTRACT

An anatomical wheelchair seat cushion system is disclosed. The system includes a flexible base having a lower surface which interfaces with the wheelchair and an upper surface which receives a fluid-containing pad which interfaces with the user and/or interfaces directly with the user. The base is anatomically contoured and includes a plurality of features for adjusting this contour prior to positioning of a user thereon and various self-adjustment features for dynamic adjustment capabilities.

55 Claims, 30 Drawing Sheets

ANATOMICAL WHEELCHAIR SEAT CUSHION SYSTEM

FIELD OF THE INVENTION

The present invention generally relates to the field of wheelchairs and, more particularly, to wheelchair seat cushion systems which are adaptable to the anatomical structure of the user and/or adjustable to achieve support-related objectives for a given user.

BACKGROUND OF THE INVENTION

A variety of wheelchair seat cushion systems which include a tray and a cushion positioned thereon have been proposed. Although many of these systems have realized significant commercial success, generally they suffer from a number of user-related drawbacks. Initially, many existing systems are relatively heavy. This increased weight is particularly disadvantageous to the user when exiting the wheelchair and collapsing the same for transport (e.g., when entering an automobile), which obviously requires removal of the wheelchair seat cushion system for storage. A significant portion of the weight of these systems is the fluid-filled cushion which is utilized since the corresponding tray is not appropriately anatomically conforming to the user. As such, designers/manufacturers have used an overabundance of fluid for the cushion to compensate for this non-conformance.

The design of the wheelchair seat cushion system can also have an effect on user comfort. For instance, heat and moisture are inevitably generated through use of the system. In the event that the system is not effective in dissipating heat and/or moisture, user discomfort and the risk of bed sores can result. Moreover, the shape of the wheelchair seat cushion system has a significant effect on user comfort. As an example, in many systems there have been significant problems with hammocking which adversely affects user comfort. Hammocking is a condition which occurs when the user is in effect being supported by the upper ply of the cushion versus the fluid therein and which is due to inadequacies in the design of the system.

The shape of the system also affects the distribution of the forces of the user's weight over the system. If force distribution is relatively poor, which equates with high or concentrated pressures, the user is susceptible to pressure sores. As such, maximization of the interfacing area between the user and the wheelchair seat cushion system is desirable. Moreover, the existence of significant shear-like forces between the user and the system can of course also contribute to patient discomfort.

Based upon the foregoing, there is a continuing need for a wheelchair seat cushion system which addresses user maneuverability and comfort issues to a greater and more effective extent than existing systems.

SUMMARY OF THE INVENTION

The present invention generally relates to a wheelchair seat cushion system which includes a base with a fluid-containing pad positioned thereon. More specifically, the upper surface of the base closely approximates the coinciding or interfacing anatomical structure of the user, and preferably includes a plurality of features to adjust the support characteristics of the system such as to account for different user anatomical structures, to maximize force distribution on the user and thus reduce overall unit pressure, to achieve the desired user interface, and/or to adapt the system to providing different support characteristics which may be effective, for instance, to account for the physical condition of the user. Based upon providing a base with these types of features, that is seeking to "match" the interfacing surfaces of the base and user versus compensating for significant differences between the base and user through utilization of increased volumes in the fluid-containing pad, system weight can also be drastically reduced.

In one embodiment, the present invention is a wheelchair seat cushion system which includes a base with a back, two laterally displaced sides, and a front pommel. The upper surface of the base includes a generally concave buttocks receiving area for the user defined by the back and aft portions of the side and pommel which substantially approximates the anatomical structure of the user, typically through adjustment of the system before or after seating of the user thereon due to structural features of the base to be discussed below. Moreover, in order to further enhance user comfort, a fluid-containing pad (e.g., preferably a flowable material) is positioned over the base and directly interfaces with the user. However, the pad need not provide the entire interface between the system and the user, and in fact the base itself may comprise the entire system in some cases. Moreover, the system may be used in other seating applications.

As noted, the system achieves many of its objectives by providing a multiplicity of adjustment capabilities and including preadjustments and/or self-adjustments. For instance, it is desirable for the base to flex in a predetermined or predefined manner when an interface is established with the user seated thereon. In this regard, an opening may extend generally horizontally through the back of the base, typically in a mid portion thereof, to provide effectively a hinged location about which the base may flex or pivot. Predetermined flexure locations may also be established by providing a general vertical opening or gap between the sides of the base and the pommel, as well as between the back of the base and the pommel, to allow for lateral or side-to-side flexing/pivoting of the base. This opening or a portion thereof may also be vertically aligned with the user's ischial tuberosities which reduces pressure concentrations typically encountered in this region. In order to maximize benefits associated with these predefined flexures of the base, preferably the fluid-containing pad is also configured to accommodate the same and so as to not adversely affect the performance of the pad.

Predetermined flexure of the base may also be established by appropriate configuration of the bottom of the base. For instance, two fore/aft extending rails or the like may be positioned under the two opposite sides of the base to each provide an axis about which the base, or more specifically the coinciding side and interconnected back section, may supportedly pivot or roll in a generally lateral manner. That is, upon for instance an outwardly directed weight concentration on one side of the base, the side of the base and its interconnected back section will pivot about this rail and the rail, through a rolling-like action, will continue to support the base. Similar support would of course be provided during an inwardly directed weight concentration and the resulting flexing or pivoting of the side of the base and its interconnected back section in generally the opposite direction. Moreover, the surface of the base which projects toward the wheelchair seat may have one or more cut-out regions to produce a predefined flexure of the base (e.g., more than 10% of this projecting surface area being cut out, and typically greater than about 30%).

The manner of interconnecting the pommel with remaining portions of the base can also provide/contribute to the noted predetermined flexure characteristics of the base. For instance, a cantilever connection may be utilized for the pommel. That is, a forward portion of the pommel may be connected to the foreword portions of the sides of the base, while an aft portion of the pommel may be displaced from the back of the base and each of its sides. This opening between the pommel and the back and sides of the base further contributes to establishing predefined flexure characteristics for the sides and back of the base and allows for generally fore/aft flexure of the pommel. Moreover, two fore/aft extending and arcuate rails may also be incorporated on the lower surface of the base under the pommel to provide for supported pivoting or flexure of the pommel longitudinally (fore/aft and thus about a lateral axis). Predetermined fore/aft flexure of the base may also be achieved/enhanced by incorporating a laterally extending channel on the bottom surface of the base.

A variety of other features may be utilized to alter the support characteristics of the system. For instance, the support characteristics of the system may be altered by adjustment of one or more of its components. In this regard, the back of the base may be in two separate pieces such that the width of the rear of the base is adjustable. Moreover, the pommel may be a separate piece from the sides and back of the base. This allows the fore/aft position of the pommel to be adjusted, the vertical position of the pommel relative to the sides of the base to be adjusted (e.g., through use of angled surfaces for those interfacing surfaces between the sides of the base and the pommel), and/or the width of the foreword portion of the base may be adjusted via a spreading apart or forcing together of the foreword portions of the sides of the base. Furthermore, the side surfaces of the sides of the base may include one or more cavities, and/or support members of varying compressibility or resiliency may be positioned therein.

Support feet may also be incorporated onto the bottom of the base to provide an interface between the base and the wheelchair surface on which it is positioned. These feet may be slidably interconnected with the base such that their respective positions may be adjusted. Moreover, one or more replaceable spacers or shims may be positioned between each of the feet and the lower surface of the base. As such, spacers or shims of varying compressibility/resiliency and/or thickness may be utilized. Each of these features may also be utilized to alter the support characteristics of the system.

The system may also incorporate additional user-comfort related features. For instance, one or more ventilation channels may be incorporated on the bottom surface of the base which assists in dissipating heat and/or reducing moisture buildup generated during use. Moreover, a cover may be provided for the noted base and fluid-containing pad which furthers these objectives, and which also approximates the contour of the base so as to not adversely affect the support characteristics of the system.

Although support adaptability is a key feature of the present invention, so to is the significant weight reduction which may be realized by the present invention. For instance, through utilization of the above-described base, the thickness of the fluid-containing pad positioned thereon may be between about ¼ inch and about 2 inches, and such may weigh between about ¼ pounds and about 2 pounds. Overall, the weight of the system may be between about 3 pounds and about 6 pounds. As such, not only is the wheelchair cushion system of the present invention significantly adaptable to user needs, but with the realizable system weight reduction, the maneuverability of such for transport, that is when removing the system from the wheelchair for storage, is also significantly improved.

DETAILED DESCRIPTION

Figure 1:
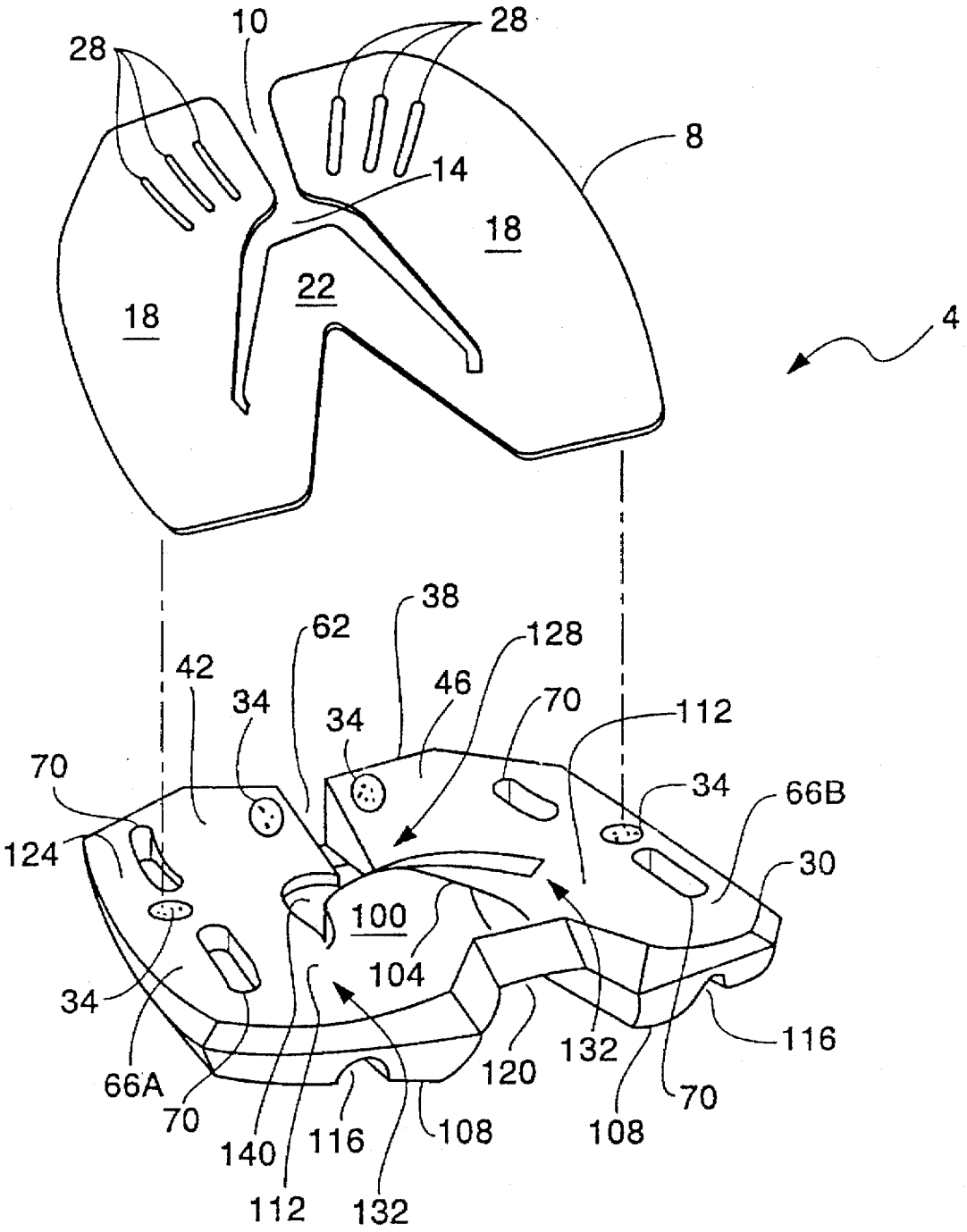
FIG. 1 is an exploded, perspective view of one embodiment of a wheelchair seat cushion system which includes a base and a pad.
Figure 2:
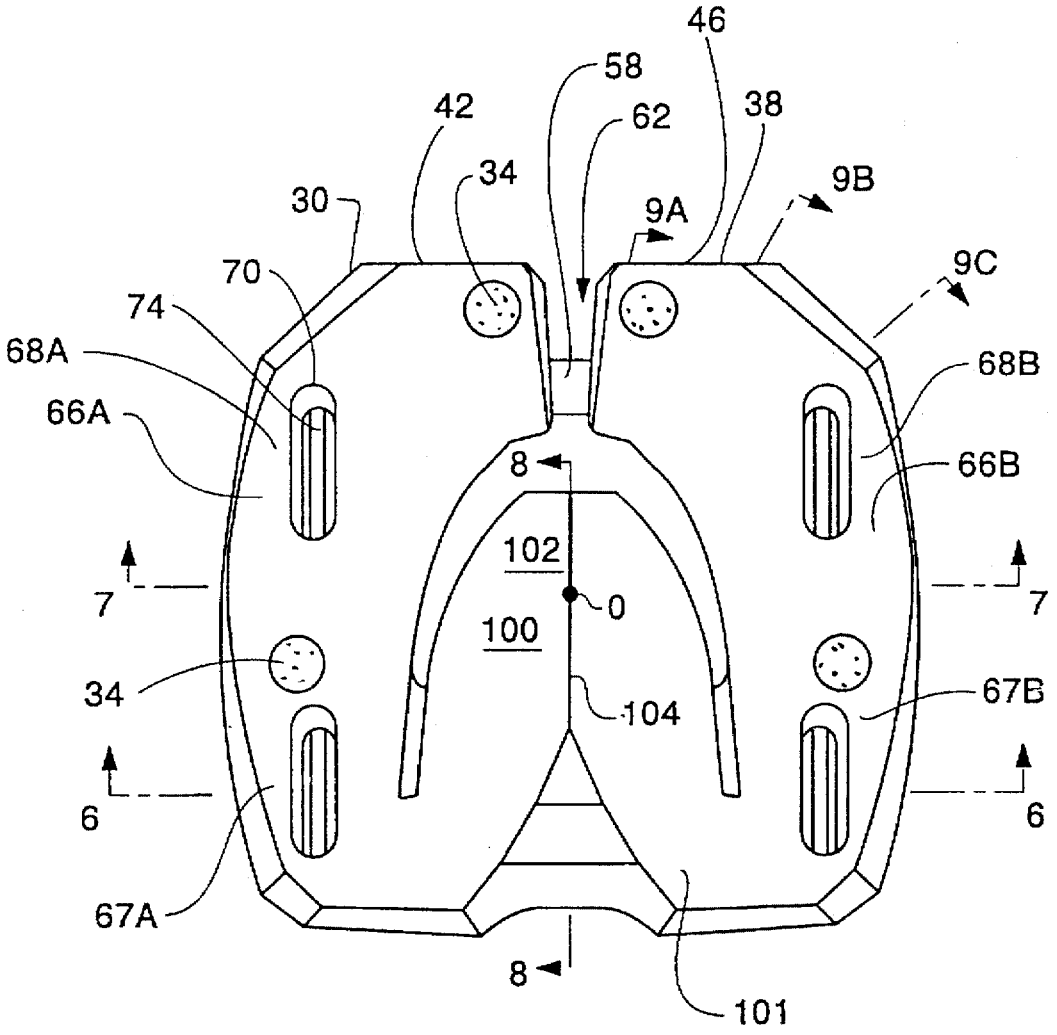
FIG. 2 is a top view of the base of FIG. 1.
Figure 3:
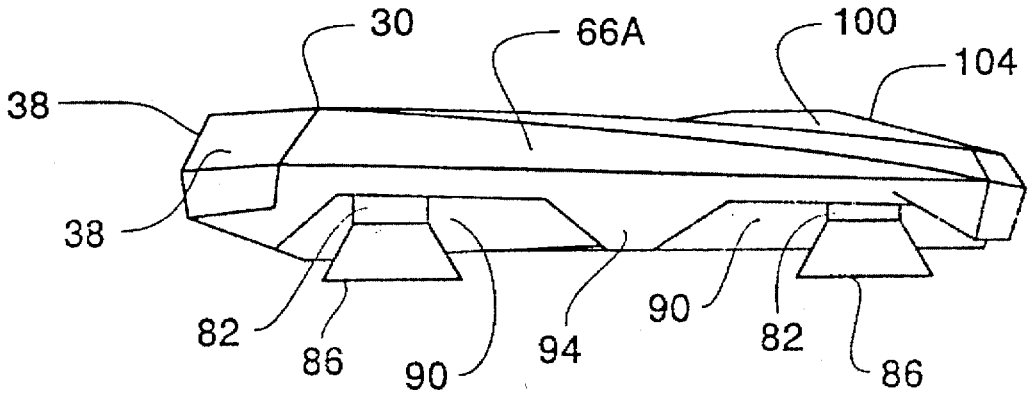
FIG. 3 is a side view of the base of FIG. 1.
Figure 4:
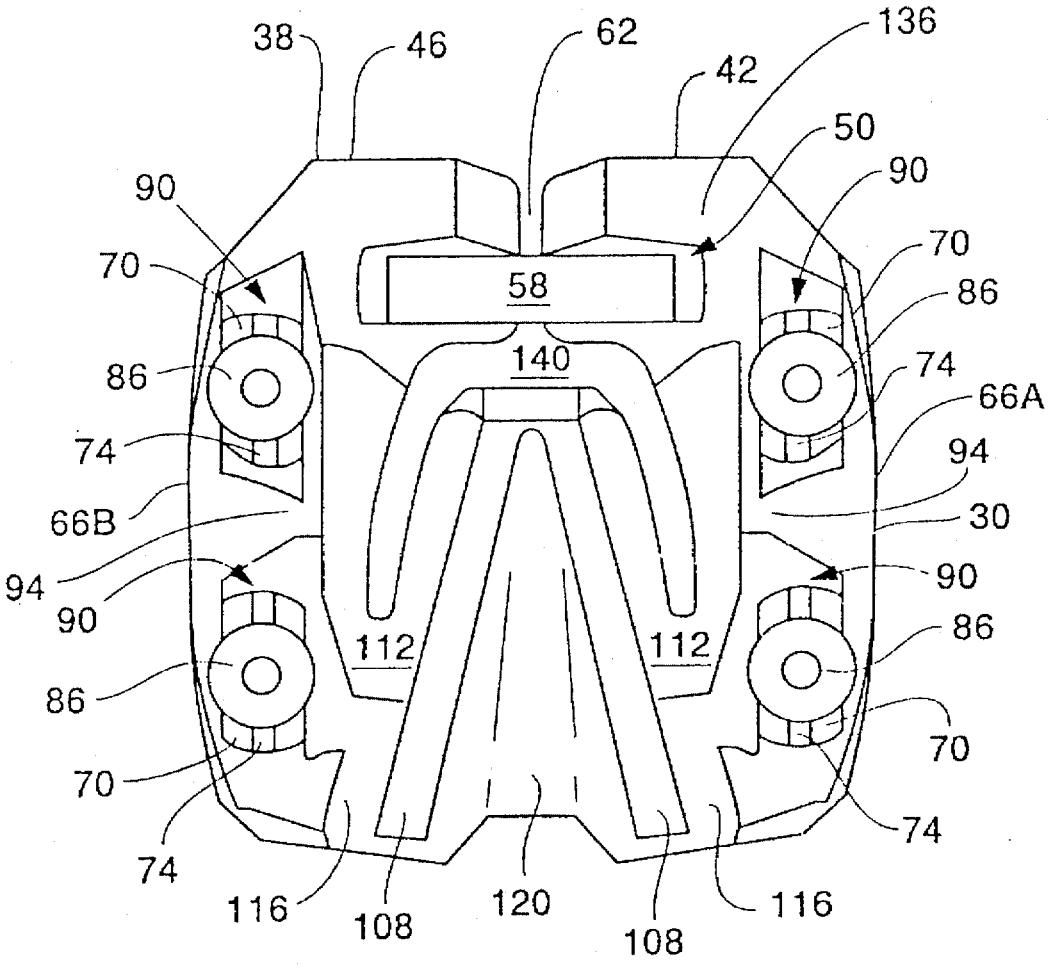
FIG. 4 is a bottom view of the base of FIG. 1.
Figure 5:
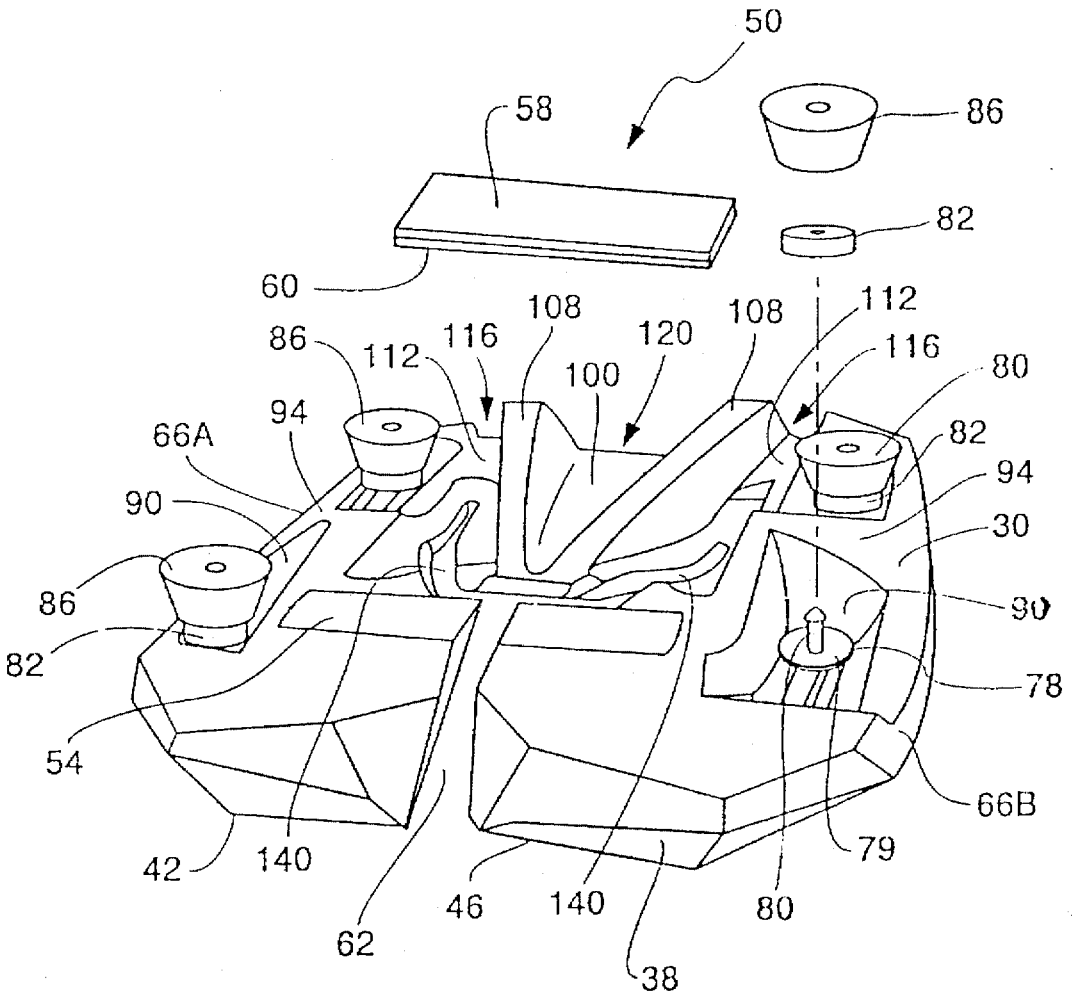
FIG. 5 is a perspective view of the bottom of the base of FIG. 1.
Figure 6:
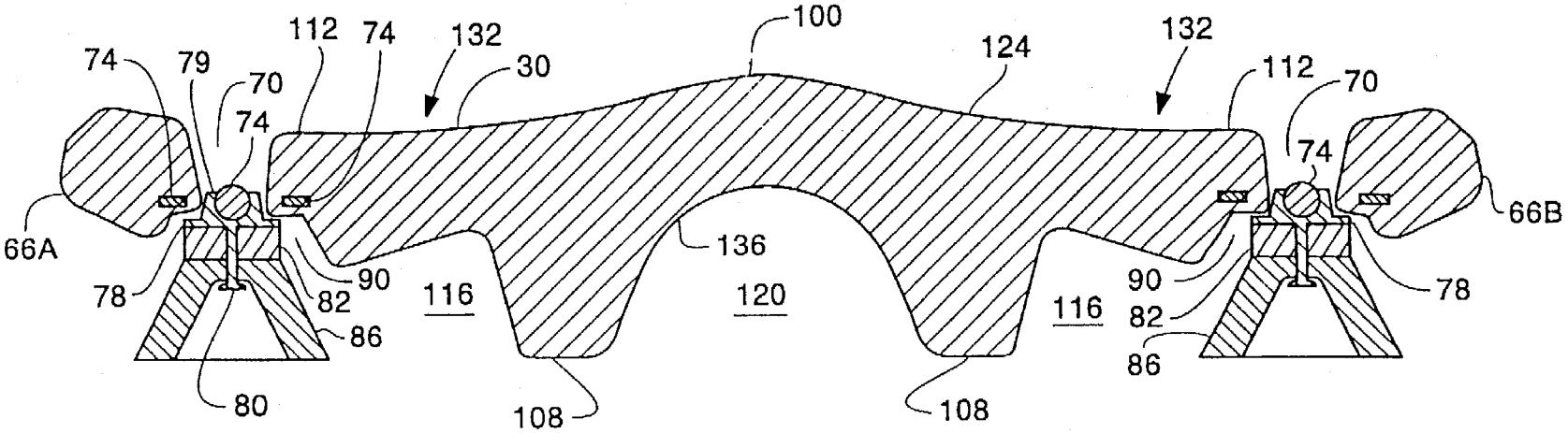
FIG. 6 is a cross-sectional view of the base of FIG. 2 taken along ling 6—6.
Figure 6A:
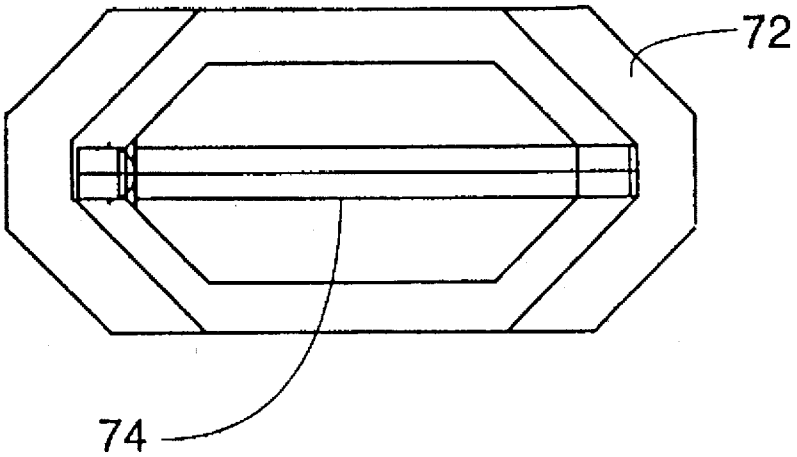
FIG. 6A is a top view of the support structure for the foot mounting assembly illustrated in FIG. 6.

One embodiment of a wheelchair seat cushion system is illustrated in FIGS. 1–9D. The system 4 includes a fluid-containing pad 8 which is disposed over a base 30. A base lower surface 136 interfaces with the wheelchair seat (not shown but, e.g., a sling-type, a solid seat type) upon which the system 4 may be positioned. A base upper surface 124 interfaces, directly and/or via the pad 8 when positioned thereon, with a user seated on the base 30. Generally, the base upper surface 124 is anatomically contoured to substantially approximate the anatomical structure of coinciding portions of the user (e.g., the base upper surface 124 closely approximates the contour of the interfacing portion of the user's body). This maximizes the distribution of the weight of the user over the base 30, and thus reduces unit pressure and increases user comfort. Moreover and as will be discussed in more detail below, the system 4 includes a variety of features which allow for adjustment of various support characteristics of the system 4 prior to any positioning of the user thereon (i.e., static support adjustments), and also for some self adjustment during use (i.e., dynamic adjustments via self-compensation). Some of the adjustment features of the system 4 are also desirable in terms of adaptation of the system 4 to the type of wheelchair seat with which it will be used.

Initially, the base 30 provides the structural support for the system 4 and is illustrated as being integrally formed (i.e., of one-piece construction). As such, the base should have a certain degree of rigidity. However, in order for the base 30 to provide the desired varying support characteristics and to maximize the distribution of the user's weight via anatomical conformance, as well as to also provide a cushioning effect, the base 30 should also have a degree of flexibility as well as compressibility. Appropriate materials for the base 30 include reaction injection molded foam, self-skinning polyurethane, and cross-linked polyurethane, having a durometer rating, Shore A, between about 40 and about 100, and typically less than about Shore 80.

Structurally, the base 30 includes a back 38, first and second laterally displaced sides 66A, 66B which are integrally formed with the back 30 and extend forwardly thereof, and a pommel 100 which is disposed on the forward portion of the base 30, which extends toward the back 38 of the base 30, and which is integrally interconnected with forward portions of the sides 66A, 66B. Generally, the portion of the base upper surface 124 defined by the back 38, aft portions 68A, 68B of the sides 66A, 66B, respectively, and an aft portion 102 of the pommel 100 collectively define a generally concave and anatomically contoured buttocks cavity 128. Moreover, the portion of the base upper surface 124 defined by the fore portion 101 of the pommel 100 and/or the intersection between the pommel 100 and the fore portions 67A, 67B of the sides 66A, 66B includes two anatomically contoured, laterally displaced leg cavities 132. As such, substantially the entirety of the base upper surface 124 is specifically designed to substantially approximate the interfacing surface of the user when seated thereon, which again maximizes distribution of the user's weight over as large of an area of the base 30 as possible and thereby minimizes the unit pressure experienced by the user.

In the illustrated embodiment, the back 38 includes a first back section 42 which is laterally displaced and completely separated from a second back section 46 by a back opening 62. Initially, this configuration of separating the back 38 into the back sections 42 and 46 allows for the existence of the back opening 62. Depending upon the size of the back opening 62, it may substantially coincide with the coccyx of the user and thereby reduce the potential for pressure concentrations on this portion of the user's anatomy when using the system 4. However, this configuration also allows for the width of the rear of the base 30 to be adjusted. In this regard, the base 30 includes a back lateral connection assembly 50 to accommodate for this width adjustment. The back lateral connection assembly 50 includes back velcro connectors 54 which are positioned on the base lower surface 136 of the back sections 42, 46. Moreover, the back lateral connection assembly 50 includes a connecting plate 58 with an interfacing velcro connector 60 positioned thereon. As such, by removing the connecting plate 58 from the base lower surface 136 of the back 38, the width of the back 38 may be increased or decreased by pulling the sections 42 and 46 apart or forcing them together, respectively. This width adjustment may be used to accommodate the anatomical structure of a particular user within a given size range and/or may be used to achieve different support characteristics for the system 4. For instance, modification of the width of the back 38 effectively alters the profile of the base upper surface 124 primarily in the region of the buttocks cavity 128, and thus changes the support characteristics of the system 4.

Figure 9A:
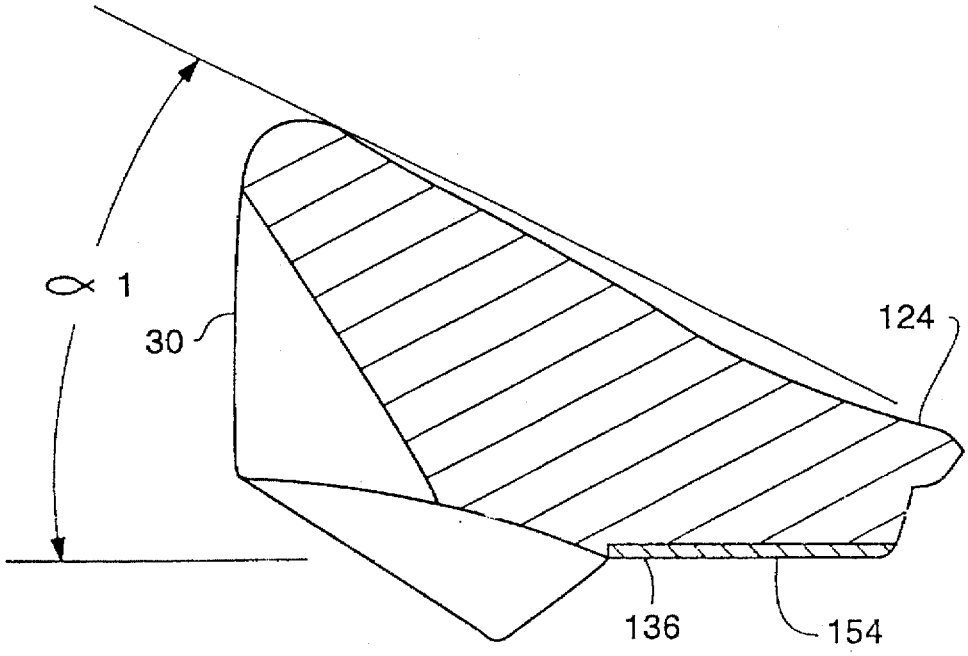
FIGS. 9A–C are cross-sectional view of the back of the base of FIG. 2 taken along the noted radii.
Figure 9B:
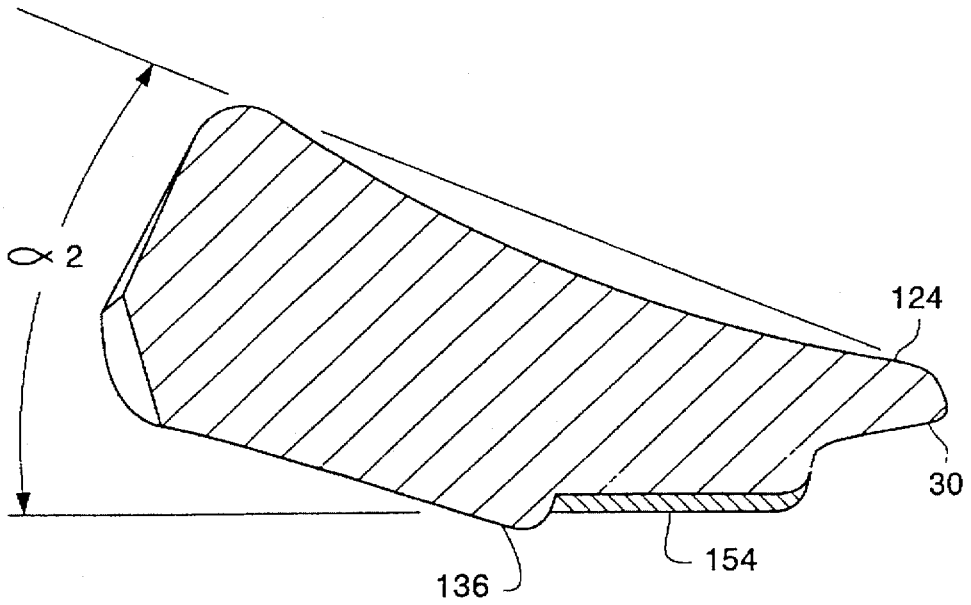
Figure 9C:
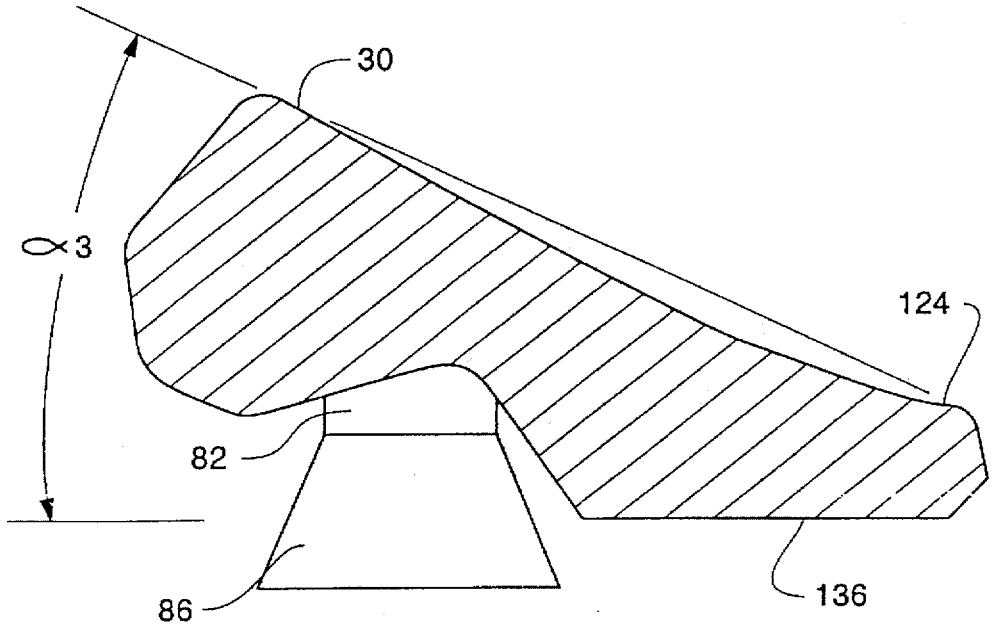
Figure 10:
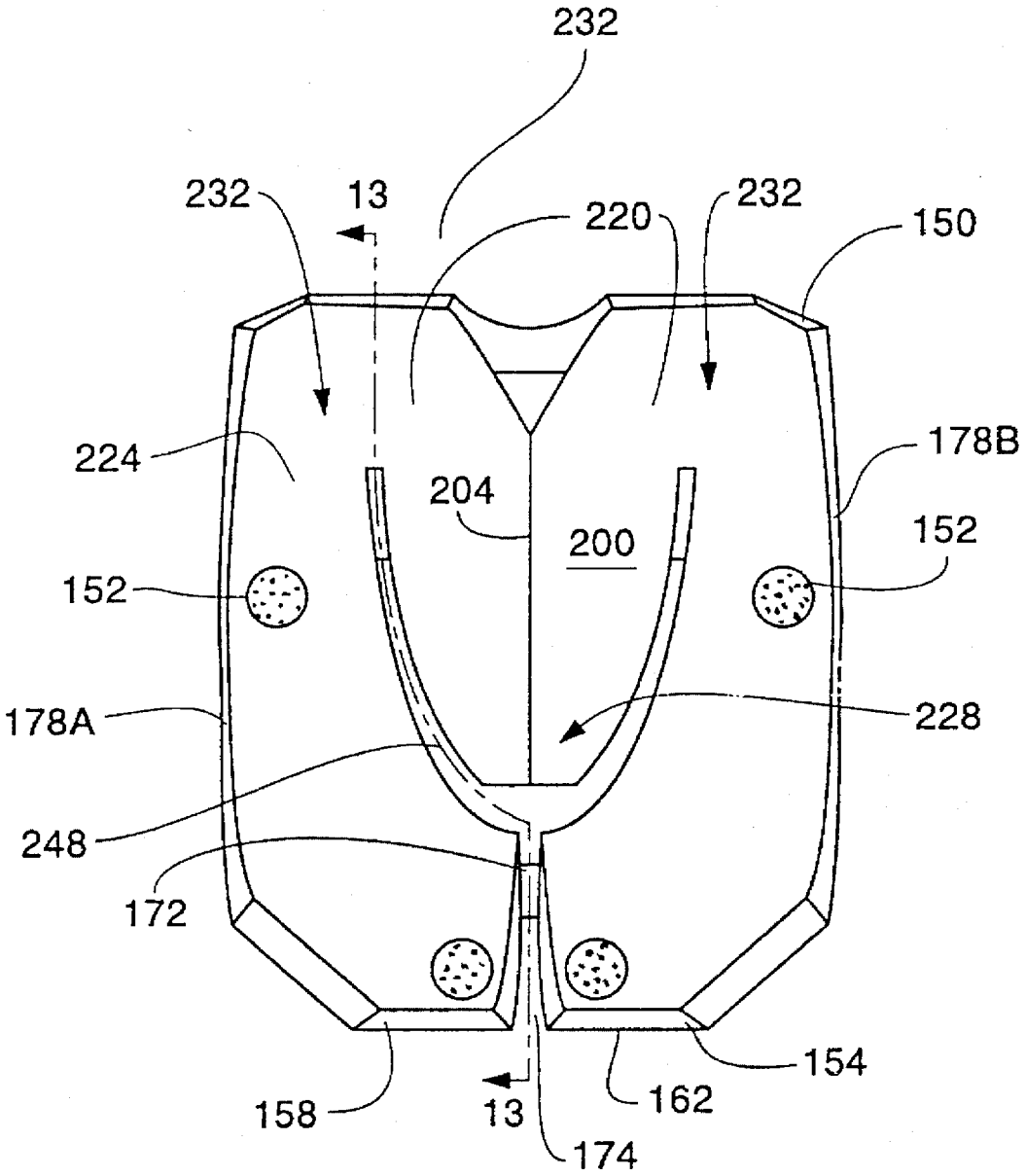
FIG. 10 is a top view of another embodiment of a base for a wheelchair seat cushion system.
Figure 11:
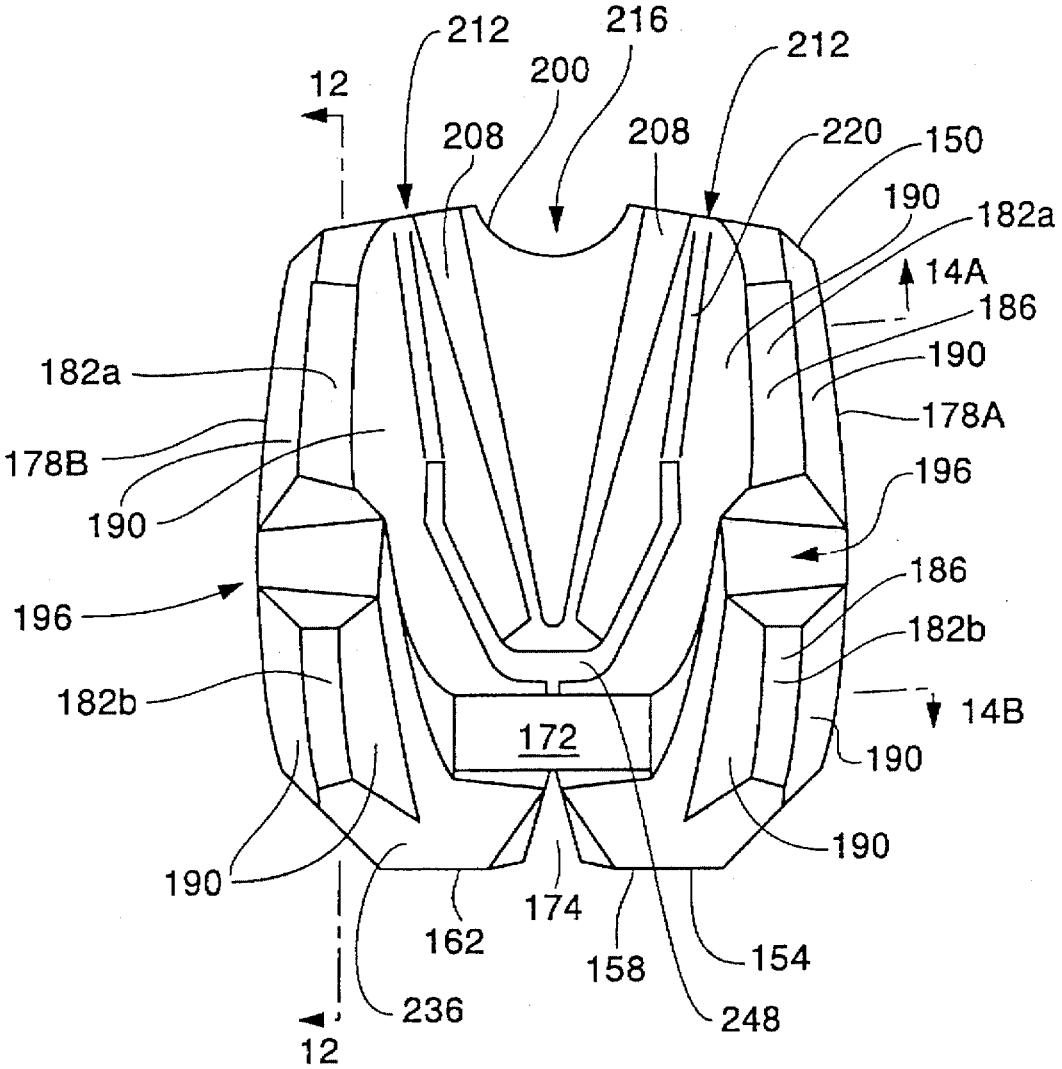
FIG. 11 is a bottom view of the base of FIG. 10.
Figure 12:
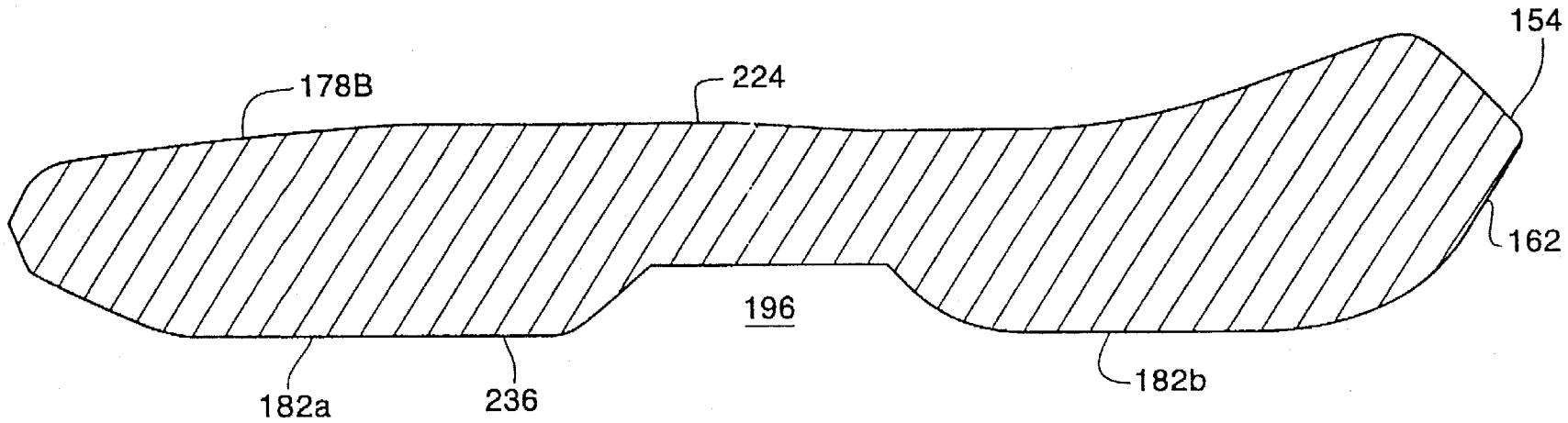
FIG. 12 is a cross-sectional view of the base of FIG. 11 taken along line 12—12.
Figure 13:
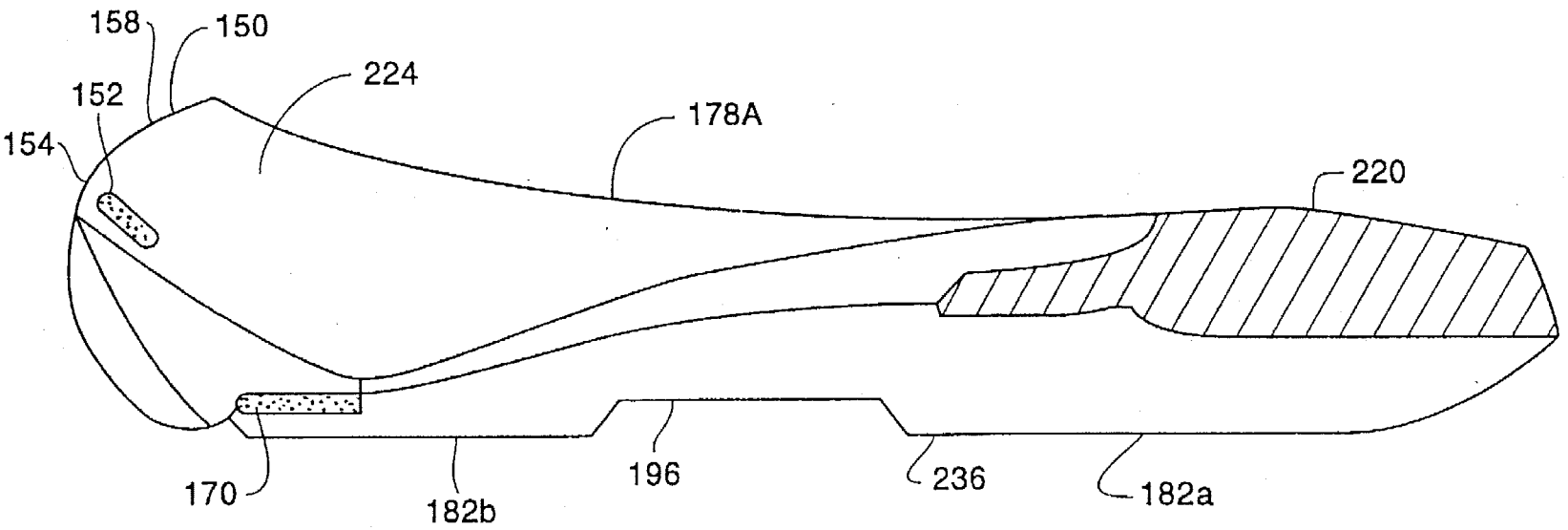
FIG. 13 is cross-sectional view of the base of FIG. 10 taken along line 13—13.
Figure 14A:
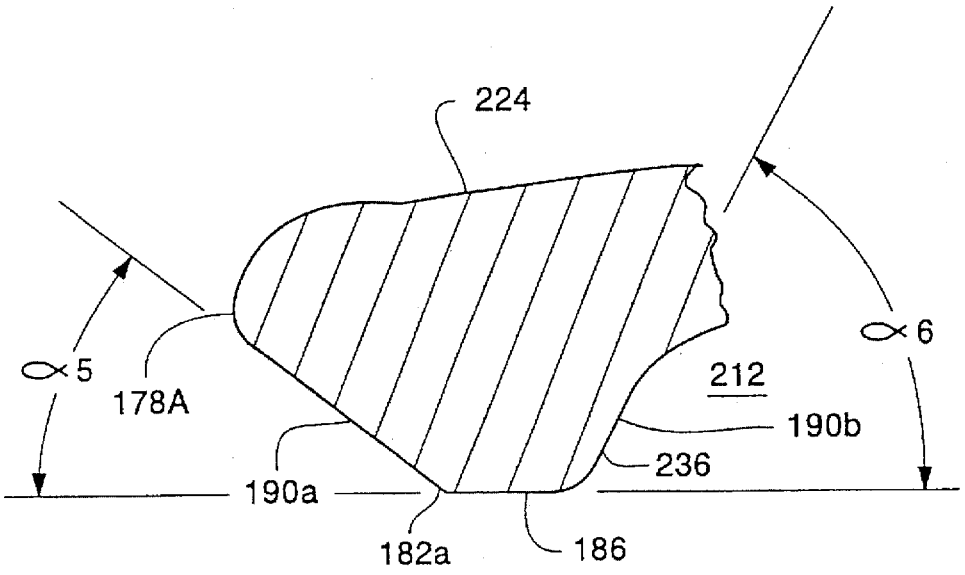
FIGS. 14A and B are cross-sectional views of the front and rear rails of the base of FIG. 11 taken along radii 14A, 14B, respectively.
Figure 14B:
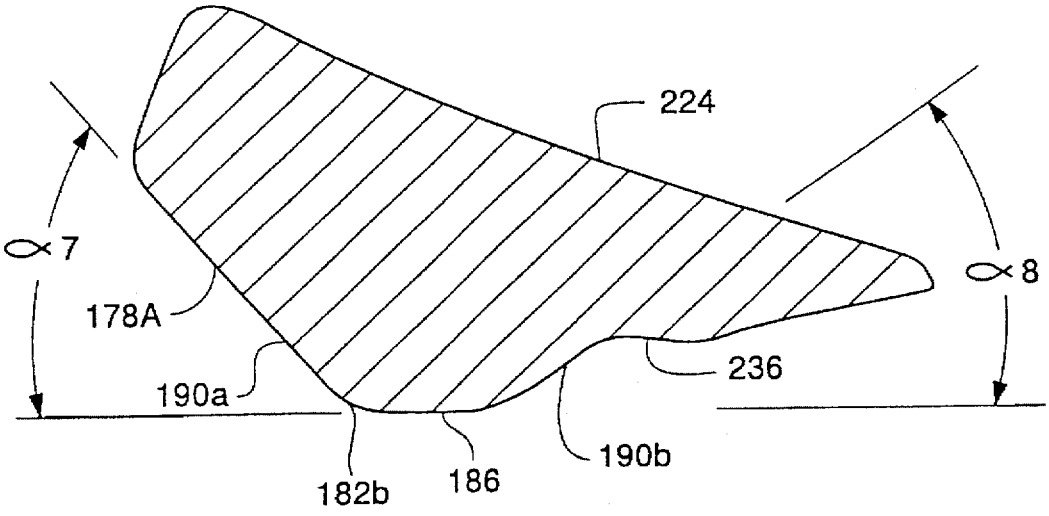

As noted, the back 38 is anatomically contoured to enhance performance of the system 4. Referring primarily to FIGS. 9A–C, it can be seen that the second back section 46 extends from the back opening 62 to the location of the cross section for FIG. 9C. Throughout the second back section 46, the contour of this portion of the base upper surface 124 is specifically configured to substantially approximate the adjacently positioned and anatomical contour of the interfacing surface of the user when positioned thereon. Generally, the base upper surface 124 defined by second back section 46 extends downwardly and inwardly toward an interior portion of the base 30 at an angle. Moreover, this portion of the surface 124 has a generally concave, arcuate extent from the rim of the back 30 to the lower portion thereof or in the vertical dimension. Furthermore, this portion of the surface 124 also has a generally concave, arcuate extent from the opening 62 to the extreme of the second back section 46 at the cross section of FIG. 9C or in the horizontal dimension.

Referring to FIG. 9A, the downward extension of that portion of the base upper surface 124 defined by the second back section 46 is generally at an angle $\alpha_1$, relative to a horizontal axis, of about 27 degrees. The upper portion is actually substantially linear, with the lower portion thereof being arcuate. The cross section of FIG. 9A is taken at an angle of about 9 degrees from the central, longitudinal axis extending through the base 30 (and along the central ridge 104 of the pommel 100), with the origin being at point "0" on this axis. At the location of the cross section of FIG. 9B, the downward extension is generally at an angle $\alpha_2$, relative to a horizontal axis, of about 23 degrees. Again, the upper portion is generally linear, with the lower portion thereof being arcuate. The cross section of FIG. 9B is taken at an angle of about 29 degrees from the central, longitudinal axis of the base 30 with the origin being at point "0" on this axis. Finally, at the location of the cross section of FIG. 9C, the downward extension is generally at an angle $\alpha_3$, relative to a horizontal axis, of about 25 degrees. Again, the upper portion is generally linear, with the lower portion thereof being arcuate. The cross section of FIG. 9C is taken at an angle of about 49 degrees from the central, longitudinal axis of the base 30 with the origin being at point "0" on this axis. The "horizontal" extent of the right back section 46 is also arcuate as noted and may be generally defined by the revolution of an inclined line about a point. The first back section 42 is similarly contoured to the second back section 46 discussed above. As such, with the noted configuration the back section 38 substantially approximates the corresponding/interfacing anatomical structure of the user when positioned on the base 30.

Figure 7:
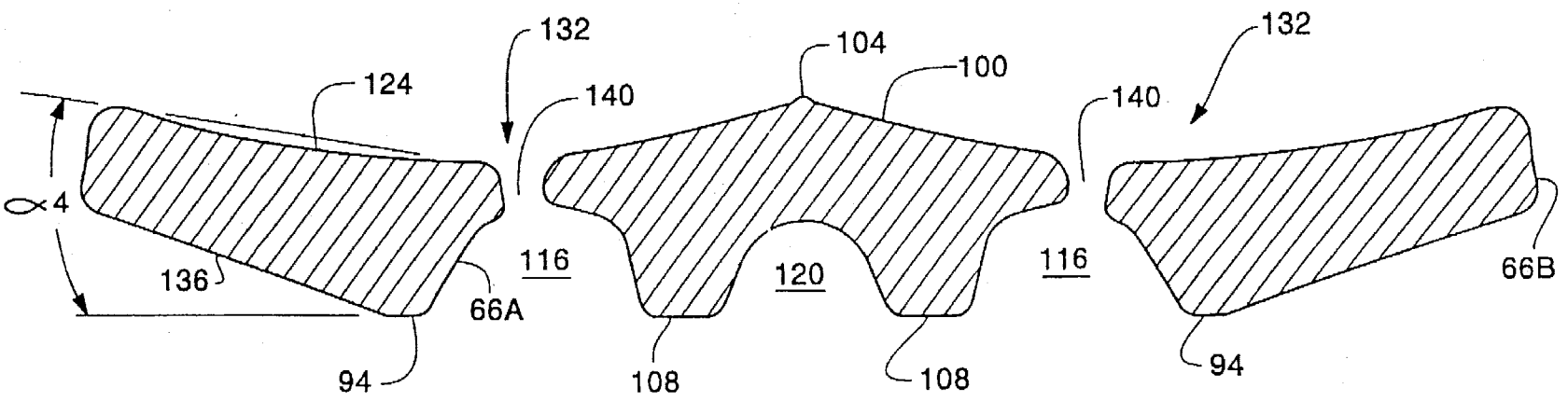
FIG. 7 is cross-sectional view of the base of FIG. 2 taken along line 7—7.
Figure 8:
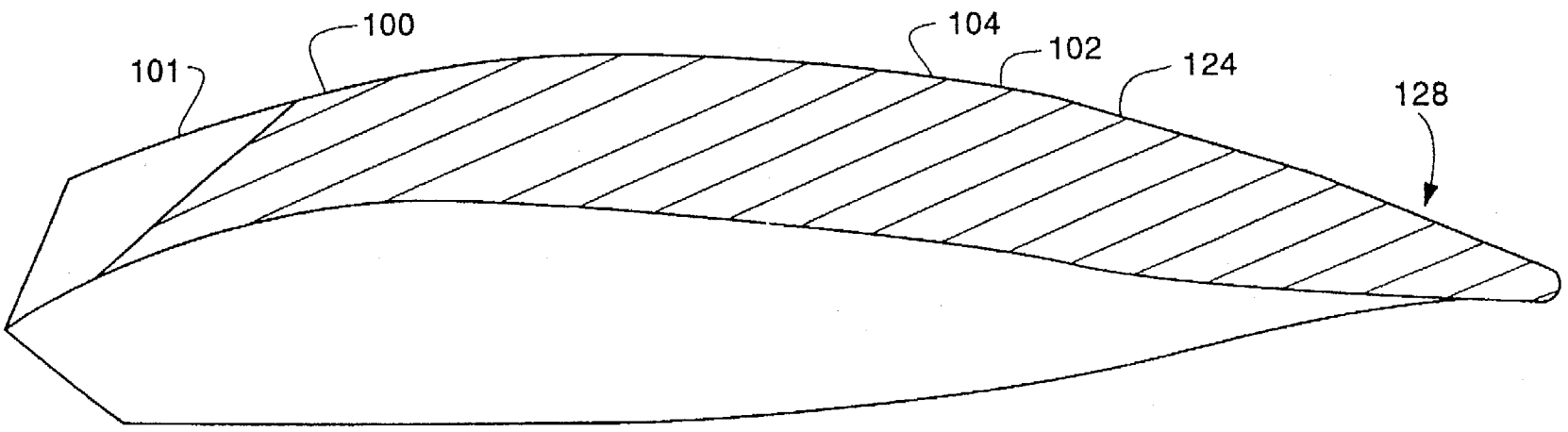
FIG. 8 is cross-sectional view of the pommel of FIG. 2 taken along line 8—8.

The sides 66A, 66B of the base 30 are each integrally interconnected with the adjacent portion of the back 38. Generally, the side 66B extends from the location of the cross section of FIG. 9C to the extreme forward portion of the base 30. The portion of the base upper surface 124 defined by the aft portions 68A, 68B of the sides 66A, 66B, respectively, namely that region extending from location of the cross-section of FIG. 9C to the location of the cross section of FIG. 7, are also anatomically contoured for substantially approximating the interfacing region with the user in defining the buttocks cavity 128. In this regard, the aft portions 68A, 68B of the sides 66A, 66B each generally extend downwardly and inwardly toward an interior portion of the base 30. Referring to FIG. 9C, the downward extension of the side 66B adjacent the second back section 46 is again at an angle $\alpha_3$, relative to a horizontal axis, of about 25 degrees, and is generally arcuately extending in this vertical extent. The aft portion 68A, 68B of the sides 66A and 66B continues the general downward extension, but to a lesser degree, as the distance from the front of the base 30 decreases. For instance, at the location of the cross section of FIG. 7, the downward extension is generally at an angle $\alpha_4$, relative to a horizontal axis, of about 9 degrees, and is generally arcuately extending in this vertical extent.

The base 30 concludes with a pommel 100 which is centrally positioned about the central, longitudinal axis of the base 30. Initially, the fore portion 101 of the pommel 100 is integrally formed with each of the corresponding fore portions 67A, 67B of the sides 66A, 66B, respectively. However, an aft portion 102 of the pommel 100 which defines part of the buttocks cavity 128 is separated from each of the sides 66A, 66B, as well as the back 38, by a generally U-shaped opening 140 which extends completely vertically through the base 30. As such, the fore portion 101 of the pommel 100 integrally interfaces with adjacent sections of the fore portions 67A, 67B, of the sides 66A, 66B, and thus forms two laterally displaced cantilever connections 112. As will be discussed in more detail below, these cantilever connections 112, as well as the configuration of the lower base surface 136 defined by the pommel 100 which interface with the wheelchair seat when positioned thereon, allow the pommel 100 to deflect or pivot or roll longitudinally about a lateral axis (i.e., one which is perpendicular to the central ridge 104 of the pommel 100) to vary the support characteristics of the system 4. Although the angular position of the aft portion 102 of the pommel will vary depending upon the degree with which the pommel 100 moves in the noted manner, the aft portion 102, which again defines part of the buttocks cavity 128, generally extends in a downward direction.

The pommel 100 also assists in the supporting of the users' legs. As such, the pommel 100 includes a central ridge 104 away from which the pommel 100 tapers downwardly toward the corresponding portions of the sides 66A, 66B. The central ridge 104 thus assists in maintaining separation of the user's legs when using the system 4. Moreover, the base upper surface 124 defined by the pommel 100 and/or corresponding portions of the sides 66A, 66B define two generally concave leg cavities 132 for the user's legs. Although the degree of concavity of the leg cavities 132 is reduced in relation to the buttocks cavity 128, it nonetheless sufficiently exists so as to generally approximate the interfacing surface of the user's legs.

Based upon the foregoing, it will be appreciated that substantially the entirety of the base upper surface 124 is specifically adapted to maximize surface contact area with the user. As such, the base 30 significantly advances the reduction of pressure concentrations on the user's interfacing tissues, which in turn enhances user comfort. Moreover, this allows the system 4 to realize significant weight reductions, which enhances maneuverability of the system 4 for transport and/or storage.

The system 4 also includes a plurality of features for allowing alteration of the support characteristic of the system 4, as well as adapting the support requirements to a particular user and/or user support requirements. For instance, and as noted above, the base 30 includes the back lateral connection assembly 50 which allows for adjustment of the width of the back 38 of the base 30. This changes the size of the back opening 62, as well as the size/profile of the buttocks cavity 128 as noted.

The support characteristics of the base 30 are also affected by the type/positioning of the contact points between the base 30 and the wheelchair seat surface upon which it is positioned. In this regard, the base 30 includes a plurality of foot members 86. These foot members 86 may be positioned about the entire periphery of the base 30 (not shown). In the illustrated embodiment, four foot members 86 are utilized—two being positioned under each of the sides 66A, 66B in a longitudinally displaced manner. The number and positioning of the foot members 86 may affect the support characteristics of the system 4.

In order to provide for a degree of adjustability of the system 4 based upon the position of the support members 86, the foot members 86 are movably interconnected with the base 30. In this regard, foot slots 70 extend through the entire vertical extent of the sides 66A, 66B. Moreover, a foot rail 74 is attached to a generally rectangularly-shaped mounting plate 72. One mounting plate 72 is positioned about each slot 70 such that the corresponding foot rail 74 extends through its corresponding slot 70. Although the slidable interconnection may be as described, a single foot rail 74 (not shown) could also be provided for all foot members 86 positioned on a given side 66 of the base 30.

Each foot member 86 is movably connected with a foot rail 74 by a foot mounting system 78 which includes a disk 79, which slidably engages the corresponding foot rail 74, and a stem 80, which extends downwardly therefrom to engage the corresponding foot member 86 such as by a snap-like interconnection. The foot members 86 are each effectively recessed to a degree within the base 30, and thus the base 30 includes a foot system channel 90 formed in the base lower surface 136 for each of the foot members 86. Due to the movable interconnection between the various foot members 86 and the base 30, the longitudinal position of the foot members 86 may be individually adjusted to alter the support characteristics of the system 4. In order to provide further adjustability of the support characteristics of the system 4, a resiliently compressible spacer 82 (e.g., formed from materials such as polyurethane foam/elastomers, neoprene rubber, and natural rubber, as well as those materials described for the base 30), may be positioned between the foot member 86 and the adjacent coinciding portion of the base lower surface 136. The spacers 82 may also be installed via the foot mounting system 78. In this case, a given foot member 86 may be removed from the foot mounting system 78 to allow replacement of the spacer 82 with a spacer 82 having different thicknesses and or resiliency/compressibility characteristics. This further provides for adjustability of the support characteristics of the system 4.

The positioning of the foot members 86 may be used to alter the support characteristics of the system 4 in the above-described manner. However, these foot members 86 allow for a "dynamic-like" adjustment of the support characteristics of the system 4, that is due to positioning of the weight of the user on the base 30 and/or any resulting shifting of the user's weight. As noted above, the back 38 is separated into two sections 42, 46 by the back opening 62. This, in combination with the foot members 86 under a given side 66 collectively defining a longitudinal axis and the manner of interconnecting the foot members 86 with the base 30, allows for an independent pivoting or rolling-like action of each side 66A, 66B and its interconnected back section 42, 46 generally about this longitudinal axis while maintaining the foot members 86 flush with the underlying wheelchair seat surface and thus providing continued support. For instance, in the case where the weight of the user is concentrated more over onto the outside of the side 66B of the base 30, the side 66B and the second back section 46 will pivot or roll about the axis of the foot members 86 under the side 66B in a generally clockwise manner viewed from the front of the base 30. Similarly, in the case where the weight of the user is concentrated more onto the inside of the side 66B of the base 30, the side 66B and the second back section 46 will pivot or roll about the axis of the foot members 86 on the side 66B in a generally counterclockwise manner viewed from the front of the base 30. As such, the base 30 may actually adapt to a repositioning undertaken by the user and minimize pressure concentrations during these movements for purposes of maintaining desired support characteristics. That is, the interfacing surface of the base 30 follows the user to a degree.

As noted above, the pommel 100 is also able to pivot or roll or deflect generally about a lateral axis extending through the pommel 100, which may also be used to alter the support characteristics of the system 4. In this regard, the portion of the base lower surface 136 defined by the pommel 100 generally includes two laterally displaced pommel rails 108 which converge moving from the fore portion 101 of the pommel 100 to the aft portion 102 of the pommel 100. The rails 108 are formed by outer pommel channels 116 and a central pommel channel 120. A forward portion of the pommel rails 116 is substantially planer and coincides with the wheelchair seat surface, while the aft portion of such pommel rails 116 tapers toward the base upper surface 124 in a generally arcuate manner. As such, in an unloaded condition only the forward portions of the pommel rails 116 actually engage the underlying wheelchair seat surface, while the rearward portions thereof will be displaced above this surface. This configuration for the pommel rails 116 thus allows the pommel 100 to pivot or roll about a lateral axis, and thus pivot or roll longitudinally, to provide desired support characteristics to the user, and to further have the pommel rails 116 to continue to provide this support during any such motion.

Another embodiment of a base which may be included within a system 4 similar to that described above is illustrated in FIGS. 10–14. The base 150 is similar to the base 30 in many respects, and thus the similarities will only be generally referenced herein. For instance, the base 150 includes a back 154 having a first back section 158 which is separated from a second back section 162 by a back opening 174. As such, the base 150 includes a back lateral connection assembly having a connecting plate 172 with a velcro connector thereon (not shown) which interconnects with velcro connectors 170 positioned on the base lower surface 236 of each of the back sections 158, 162.

The base 150 further includes two laterally displaced sides 178A, 178B, each of which are integrally interconnected with the corresponding adjacent portion of the back 154. Furthermore, a pommel 200 is connected with the sides 178A, 178B in the above-described manner. That is, two cantilever connections 220 interconnect the forward portion of the pommel 200 and each of the sides 178A, 178B, and a generally U-shaped opening 248 extends entirely through the vertical extent of the base 150 to separate the aft portion of the pommel 200 from each of the sides 178A, 178B and the back 154. The base upper surface 224 of the base 150 is also contoured substantially similarly to the base upper surface 124 discussed above, and thus includes an anatomically contoured buttocks cavity 228 and leg cavities 228 on the pommel 200 and/or sides 178A, 178B. Consequently, except for the absence of foot slots 70 for movable foot members 86 on the base 150, the base upper surface 224 of the base 150 is substantially similar to the base upper surface 124 of the base 30.

A primary distinction between the base 150 and the base 30 is the configuration of the base lower surface 236 in relation to the base lower surface 136 of the base 30. Initially, however, the pommel 200 does include two pommel rails 208, outer pommel channels 212, and a central pommel channel 216 similar to those corresponding portions discussed above with regard to the pommel 100. As such, the pommel 200 is able to pivot or roll or deflect about a lateral axis longitudinally (fore and aft) in the above-described manner. Consequently, it is the perimeter support of the base 150 which differs from that of the base 30.

Instead of having the foot members 84 discussed above with regard to the system 4 and the base 30, the base 150 includes four generally longitudinally extending side rails 182. Two of the side rails 182 are positioned under each of the sides 178 of the base 150 and are longitudinally displaced by a lateral channel 196. The side rails 182, as well as the pommel rails 208, are formed by cutting out or cutting away portions of the lower base surface 236. The degree of "cutting out" may be based upon a percentage of the total interfacing surface between the base lower surface 236 when on a wheelchair seat in comparison to a similarly dimensioned base but with a planar bottom. In this regard, the amount of "cut-out" on the base 150 is greater than about 30%. Cutting out portions of the base lower surface 236 thus may be used to produce a predefined flexure of the base. In fact, this methodology may be the primary basis for achieving an improved interface with the user, and by utilizing a cut-out region as small as about 10%.

Each of the side rails 182 includes a bottom surface 186 which is substantially planer and horizontally disposed and which initially interfaces with the wheelchair seat surface, as well as two side surfaces 190 which each extend upwardly and outwardly from the bottom surface 186. In this regard and for the forward positioned side rails **182*a* representatively illustrated in FIG. 14A, the most outwardly disposed side surface 190*a* of each of the forward side rails 182*a* extends generally in the noted manner at an angle $\alpha_5$ relative to horizontal of about 37 degrees, while the innermost side surface 190*b* of each of these forward rails 182*a* each extend in the noted manner generally at an angle $\alpha_6$ relative to horizontal of about 62 degrees. In the case of the two aft-disposed side rails 182*b* representatively illustrated in FIG. 14B, the outermost side surfaces 190*a* thereof extend in the above-noted manner generally at an angle $\alpha_7$ of about 48 degrees relative to horizontal, whereas the innermost side surfaces 190*b*** extend in the noted manner generally at an angle $\alpha_8$ of about 36 degrees relative to horizontal.

The side rails 182 allow for a "dynamic-like" adjustment of the support characteristics of the system 4, that is due to positioning of the weight of the user on the base 150 and/or any resulting shifting of the user's weight. As noted above, the back 154 is separated into two sections 158, 162 by the back opening 174. This, in combination with the two side rails 182 under a given side 178 defining a longitudinal axis, allows for an independent supported pivoting or rolling-like action of each side 178 and its interconnected back section 158, 162 generally about this longitudinal axis. For instance, in the case in which where the weight of the user is concentrated more over onto the outside of the side 178B of the base 150, the side 178B and the second back section 162 will pivot or roll about the axis of the side rails 182 under the side 178B in a generally clockwise manner viewed from the rear of the base 150. In this case, the outermost side surfaces 190*a* of these rails 182 may actually interface with the wheelchair seat and support the base 150 thereon. Similarly, in the case where the weight of the user is concentrated more onto the inside of the side 178B of the base 150, the side 178B and the second back section 162 will pivot or roll about the axis of the side rails 182 on the side 178B in a generally counterclockwise manner viewed from the rear of the base 150. In this case the innermost side surfaces 190*b* of these rails 182 may actually interface with the wheelchair seat and support the base 150 thereon. As such, the base 150 may actually adapt to a repositioning undertaken by the user and minimize pressure concentrations during these movements for purposes of maintaining desired support characteristics.

Figure 16:
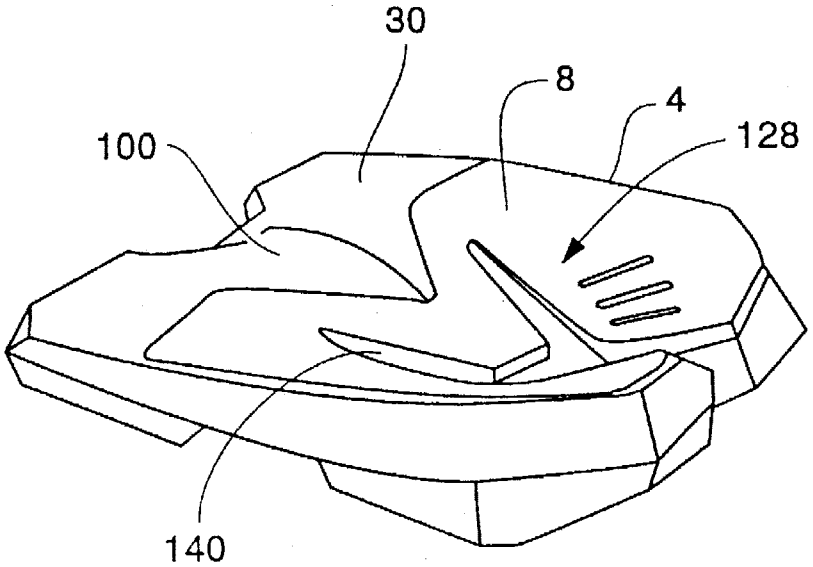
FIG. 16 is a perspective view of the pad of FIG. 15 positioned on a base such as the base of FIGS. 2 and 11.
Figure 15:
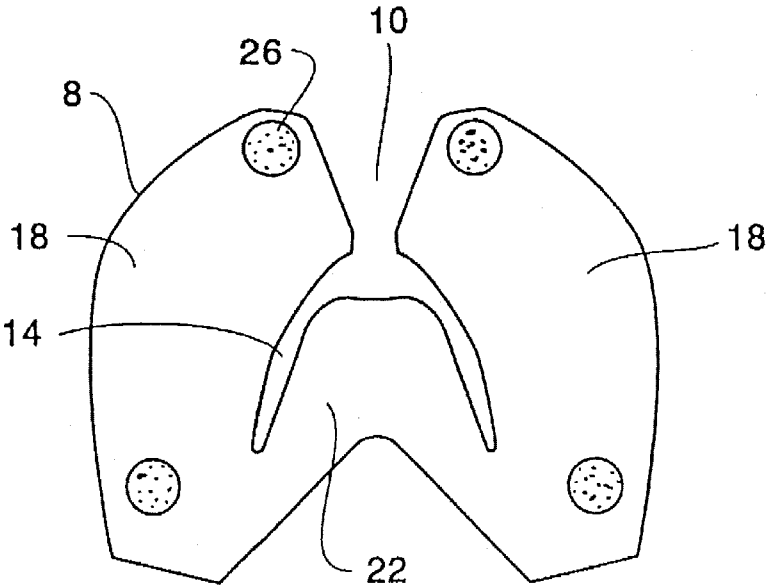
FIG. 15 is a bottom view of the pad of FIG. 1 and which may also be used with the base of FIG. 11.

As noted above referring to FIGS. 1, 15 and 16, the system 4 includes a pad 8 which is positioned over part of the base upper surface 124. However, the pad 8 may actually not be necessary if a certain degree of anatomical conformance is achieved by the base. Nonetheless, preferably the pad contains a flowable material as described in U.S. Pat. No. 3,402,411 by Alden Hanson, issued Sep. 24, 1968; U.S. Pat. No. 3,635,849 by Alden Hanson, issued Jan. 18, 1972; U.S. Pat. No. 4,038,762 by Swan, Jr., issued Aug. 2, 1977; U.S. Pat. No. 4,083,127 by Chris Hanson, issued Apr. 11, 1978; U.S. Pat. No. 4,108,928 by Swan, Jr., issued Aug. 22, 1978; U.S. Pat. No. 4,144,658 by Swan, Jr., issued Mar. 20, 1979; U.S. Pat. No. 4,229,546 by Swan, Jr., issued Oct. 21, 1980; U.S. Pat. No. 4,243,754 by Swan, Jr., issued Jan. 6, 1981; U.S. Pat. No. 5,093,138 by Drew et al., issued Mar. 3, 1992; U.S. Pat. No. 5,100,712 by Drew et al., issued Mar. 31, 1992 and U.S. Pat. No. 5,204,154 by Drew et al., issued Apr. 20, 1993, the entire disclosures of which are incorporated by a reference herein. Moreover, preferably the pad 8 is formed from a suitable flexible material and desirably is a pliable, thermo-plastic, resinous film (e.g., polyurethane, PVC).

Generally, the pad 8 is configured such that it may be positioned on the base upper surface 124 in a manner in which substantially no wrinkles are introduced into the pad 8 due to this placement. As such, the pad 8 includes a back slot 10 which effectively separates the pad into two generally L-shaped sections 18. Moreover, a generally U-shaped slot 14 is positioned on a central portion of the pad and meets with the back slot 10, such that a substantially V-shaped intermediate section 22 is disposed between each of the L-shaped sections 18. Moreover, the pad 8 includes pad velcro connectors 26 which interface with velcro connectors 34 on the base upper surface 124. Control of the flowable material throughout the pad 8 is in part achieved through utilization of flow barriers 28 (e.g., by attaching the upper pliable surface of the pad 8 to its lower pliable surface) which are disposed in the L-shaped sections 18, and generally coincide with that portion of the pad 8 which interfaces with the back 38 of the base 30. Consequently, the pad 8 is also able to pivot or fold in a predetermined manner similarly to the above-described bases 30, 150.

As noted above, one of the advantages of configuring the base 30 to closely approximate the contour of the user is to maximize surface contact area with the base 30 and thus maximize distribution of the user's weight over the base 30. However, another desirable benefit is that the amount of flowable material required for the pad 8 is also reduced, particularly when such is similarly configured to the base upper surface 124. For instance, the thickness of the pad 8 may be reduced to a range from about ¼ inch to about 2 inches. Moreover, the pad 8 may weigh between about ¼ pound and about 2 pounds. Furthermore, the total weight of the system 4 may range from about 3 pounds to about 6 pounds.

Figure 17:
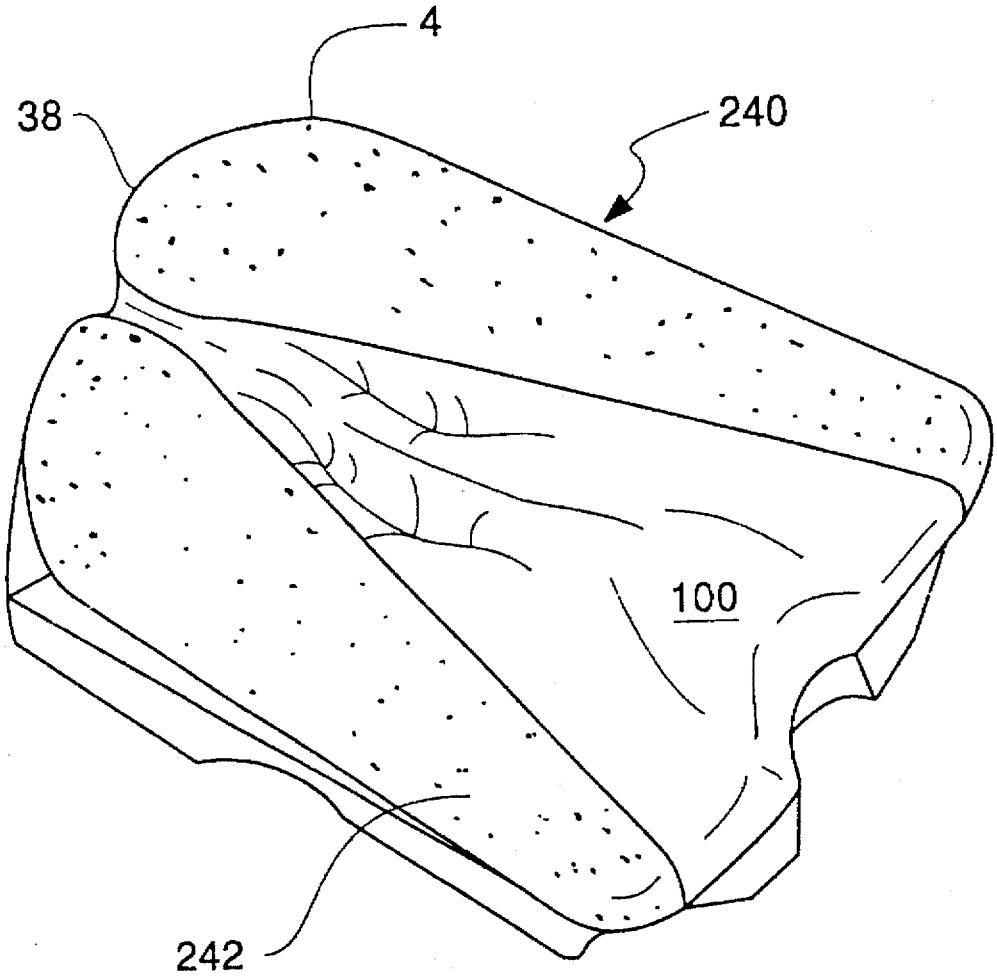
FIG. 17 is a perspective view of a cover assembly for the wheelchair seat cushion system of FIG. 1 and which may also be used with base of FIG. 10 in such a system.
Figure 18:
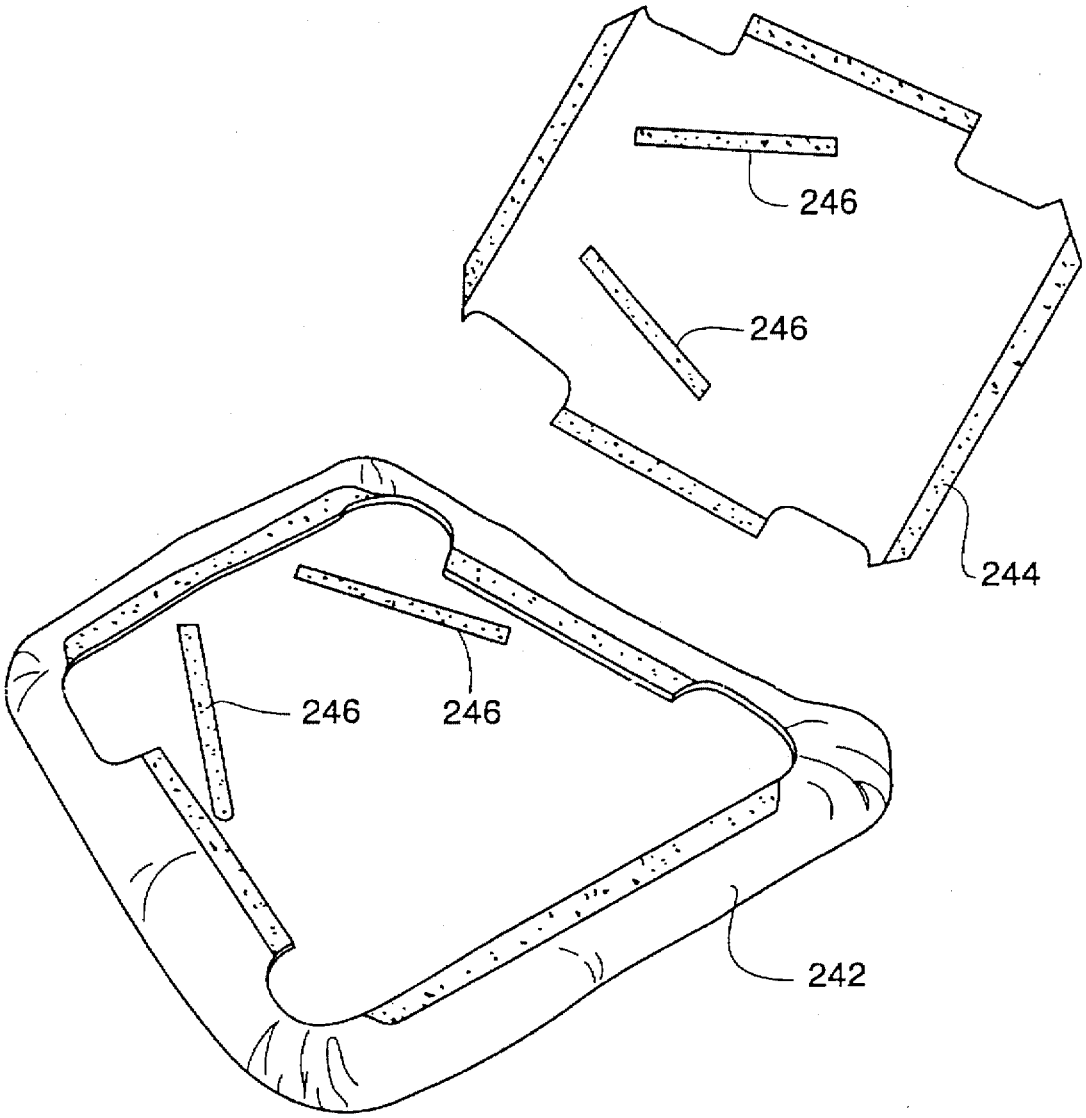
FIG. 18 is an exploded perspective view of the bottom of the cover assembly of FIG. 17.
Figure 19:
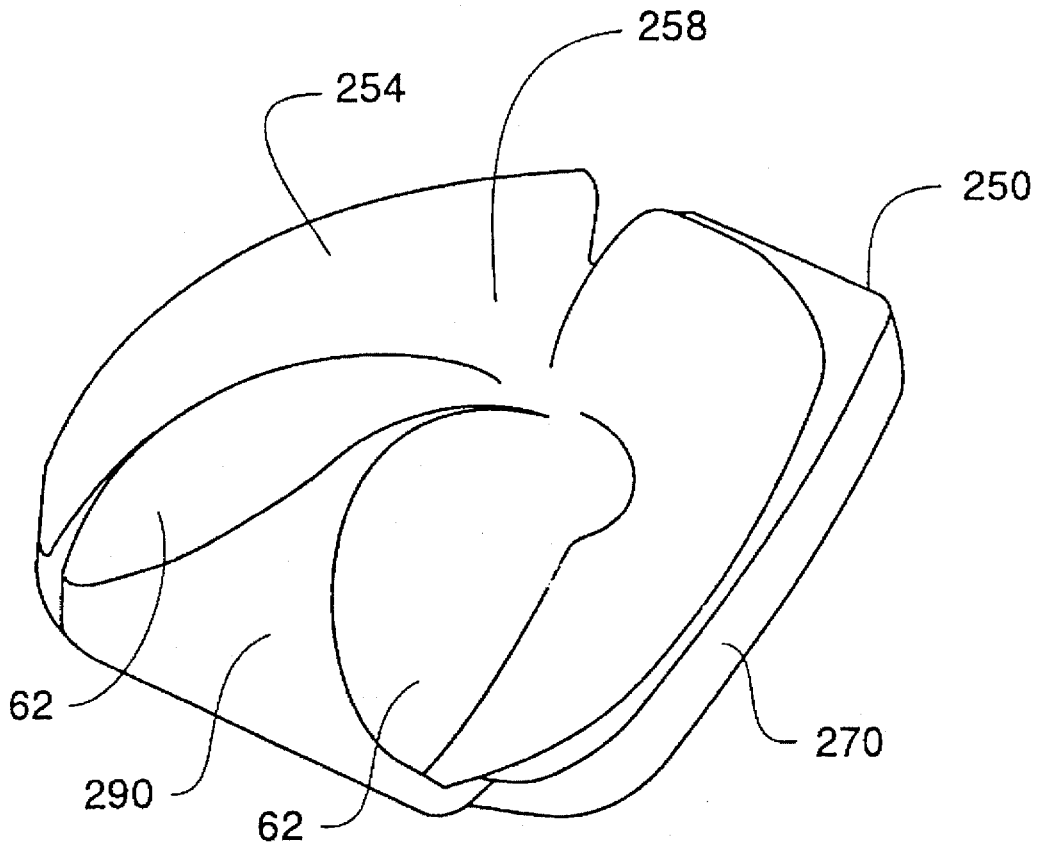
FIG. 19 is another embodiment of a wheelchair seat cushion system which includes a base and pad.
Figure 20A:
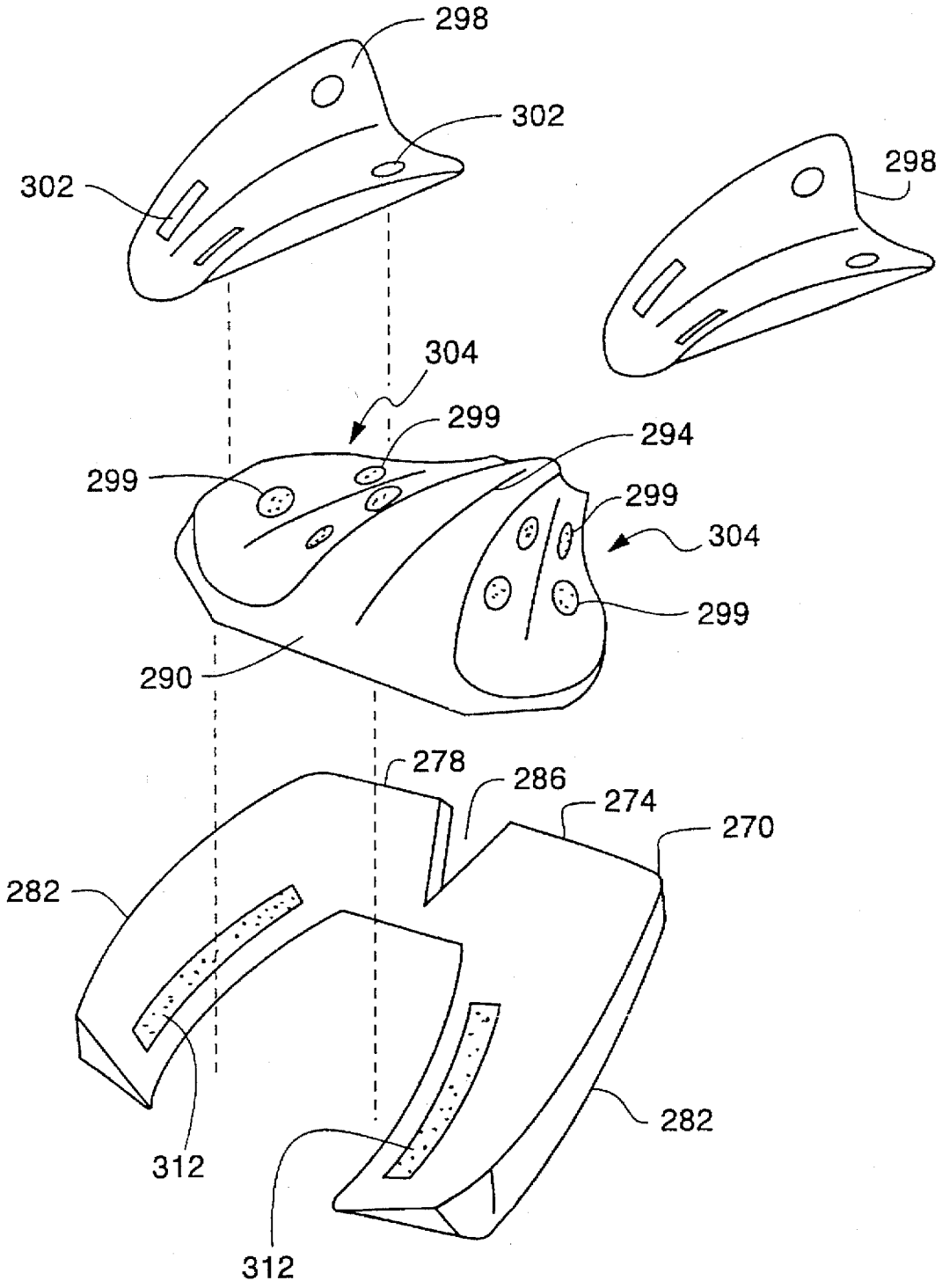
FIGS. 20A and B are an exploded perspective view and a top view the base of FIG. 19.
Figure 20B:
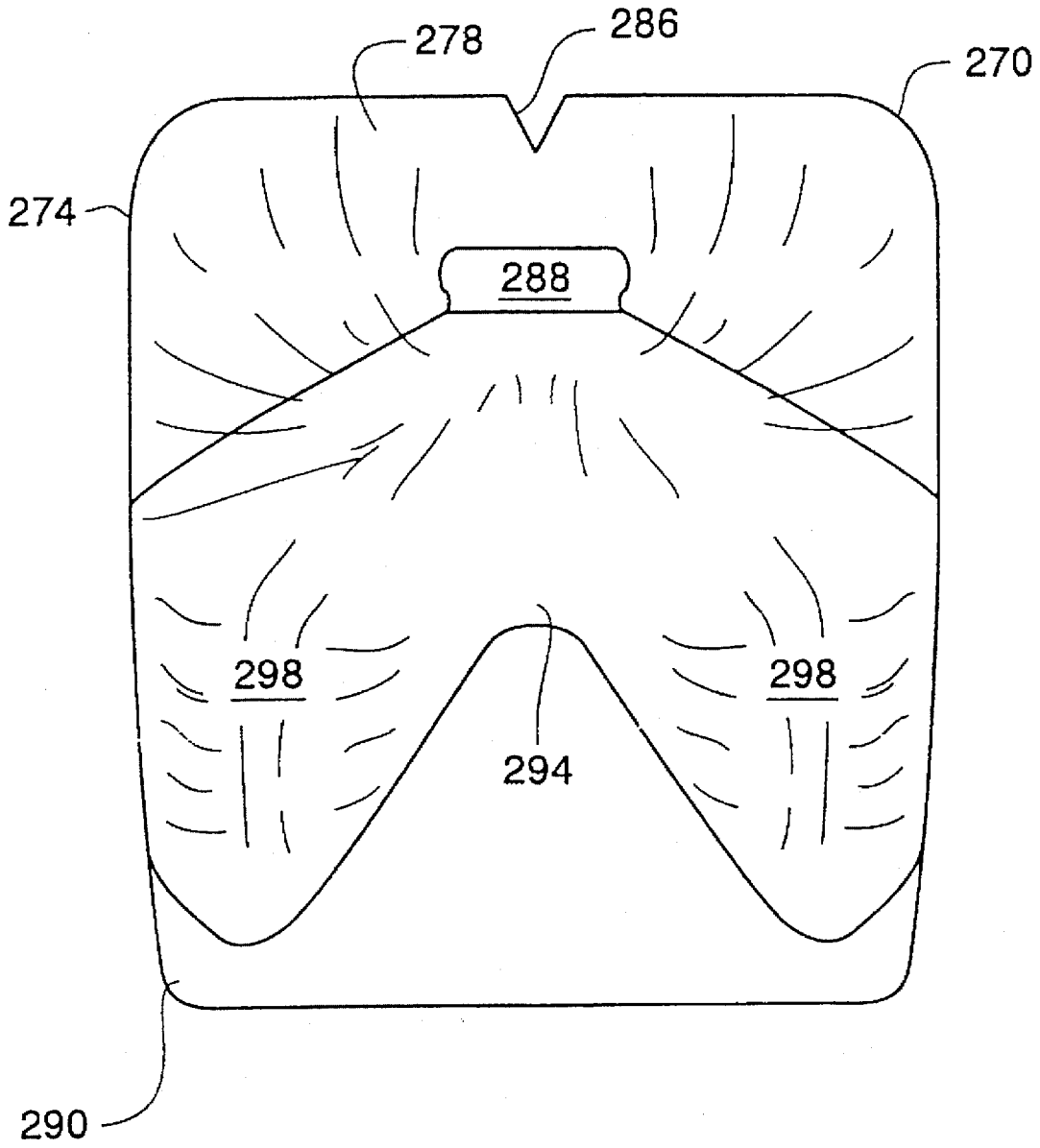
Figure 21A:
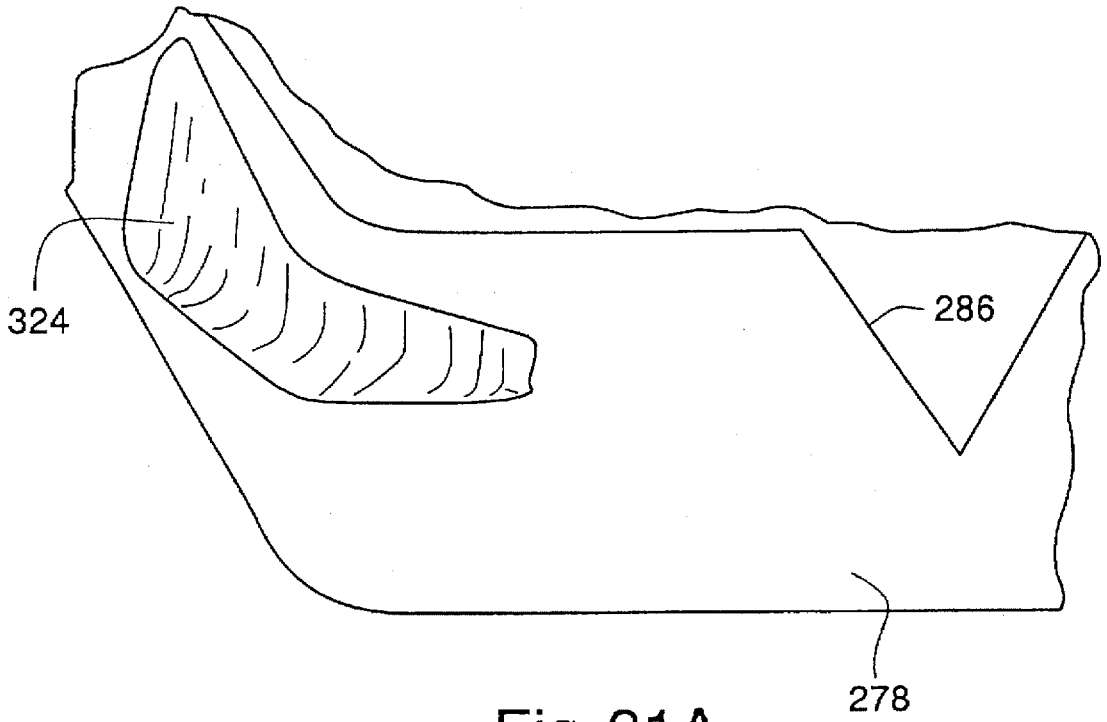
FIGS. 21A—B are views illustrating a deflection cavity and an insert therefor, respectively.
Figure 21B:
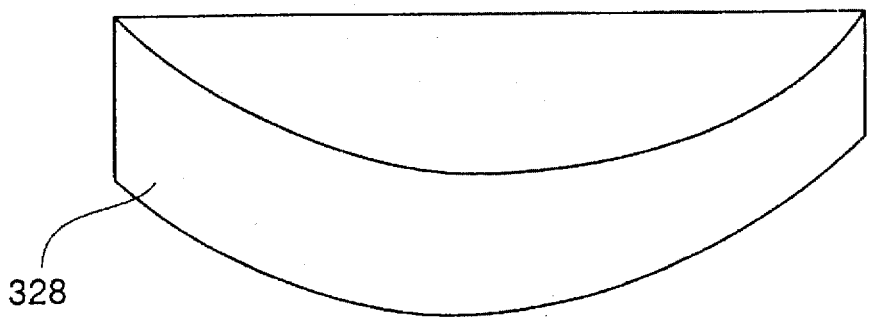
Figure 22:
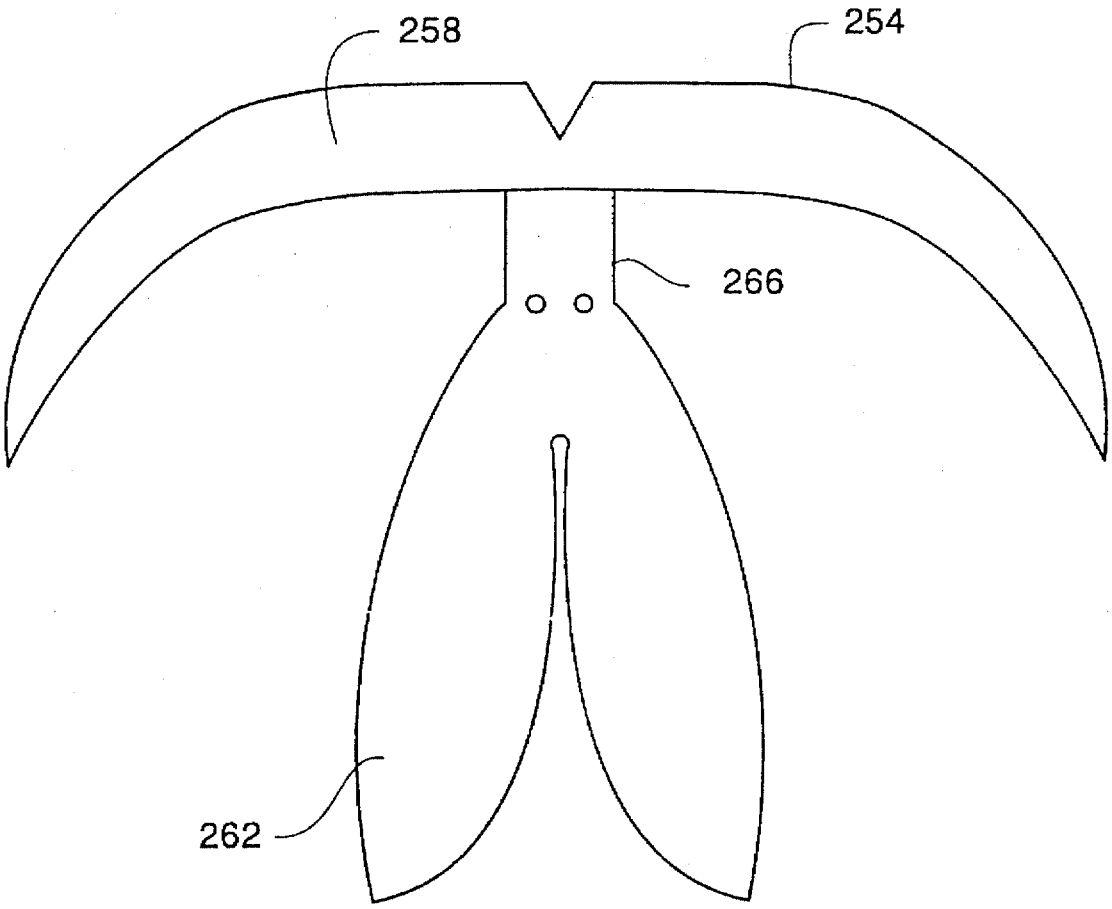
FIG. 22 is a plan view of the pad of FIG. 19.
Figure 23:
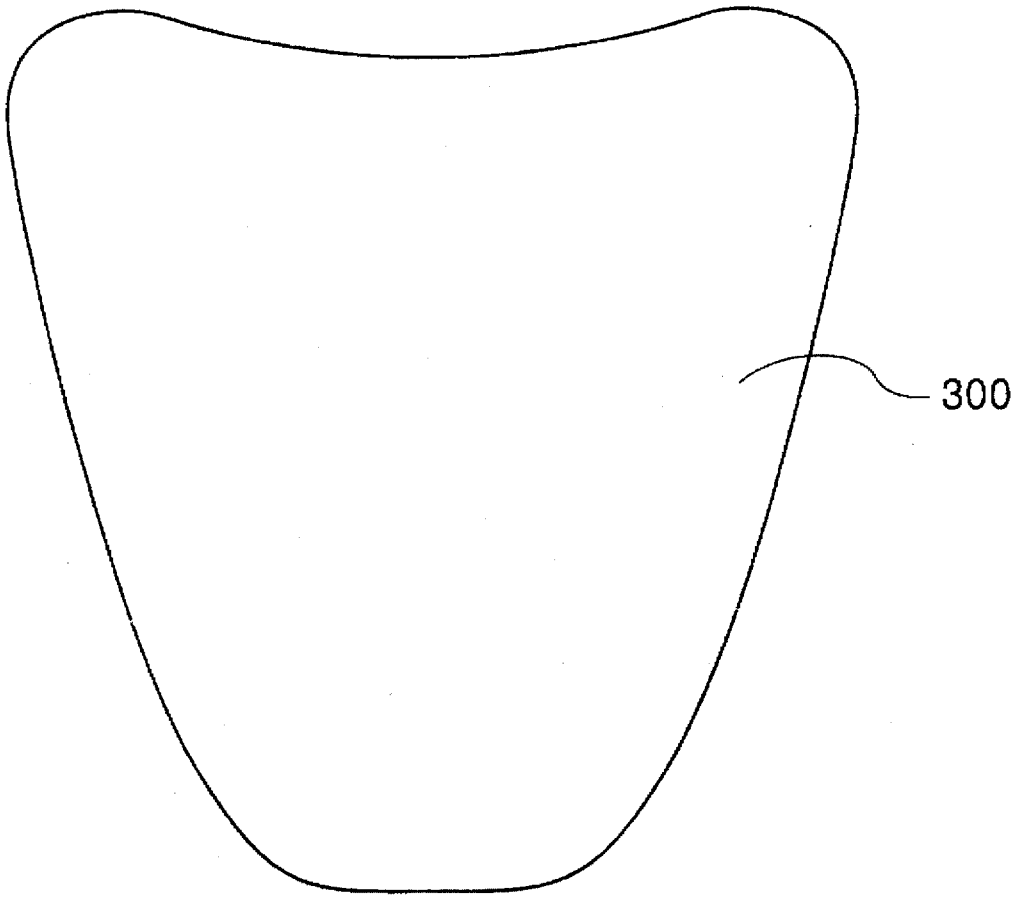
FIG. 23 is a top view of a pommel flow pack for one of the leg cavities of the pommel illustrated in FIG. 20A.

Primarily for aesthetics, the system 4 may also include a cover assembly 240 having an upper cover 242 and a removable back cover 244 as illustrated in FIGS. 17–18. In order to further enhance performance of the system 4, the cover 240 may include matching/aligned velcro connectors 246 to attach the upper cover 242 to the back cover 244 in predetermined regions. In this regard, the velcro connectors 246 are positioned to coincide with portions of the generally U-shaped opening 140 in the base 30. As such, the cover assembly 240 does not promote a hammocking or a suspension of the user above the surface of the base 30, and thus contributes to enhanced user comfort.

Another wheelchair seat cushion system is disclosed in FIGS. 20–23, and such includes certain features similar to that discussed above with regard to the system 4. In this regard, the system 250 includes a rigid but flexible/compressible base 270 with a fluid-containing (e.g., flowable material) pad 254 positioned thereon. The base 270 primarily utilizes a two-piece structure, in contrast to the integral structure of the bases 30 and 150 discussed above. More specifically, the base 270 includes a generally U-shaped perimeter section 274 and a pommel 290 which is detachably connected thereto (e.g., the pommel 290 and U-shaped perimeter section 274 are separable). Similar to the above-described embodiments, a base upper surface 284 of the base 270 is anatomically contoured to maximize the area over which the users weight is distributed. However, the base 270 includes a substantially oval-shaped ischial opening 288 which extends completely through the base 270 and which is vertically aligned with the ischial tuberosities of the user and the pommel 290 interfaces with the side sections 282 the entire length thereof. This opening 288 is larger than the U-shaped openings discussed above with regard to the bases 30, 150.

The U-shaped perimeter section 274 is integrally formed (i.e., of solid one-piece construction) and includes a back section 278 and two laterally displaced side sections 282. A V-shaped back notch 286 is disposed in the back section 278 substantially on the central, longitudinal axis of the base 270. In contrast to the back openings 62, 174 discussed above, the back notch 286 does not extend through the entire vertical extent of the back section 278, and thus does not separate the back section 278 into two separable pieces. Consequently, the width of the rear of the base 270 may not be adjusted in contrast to the bases 30, 150 discussed above. However, the back notch 286 still does allow for a flexure of the base 270 generally in the above described manner. That is, upon experiencing a weight concentration on an outwardly directed portion of a given side section 282, this side section 282 and its integrally interconnected portion of the back section 278 (i.e., up to the notch 286) is able to deflect outwardly substantially about a longitudinal axis. Similarly, a given side section 282 and its integrally interconnected portion of the back section 278 (i.e., up to the notch 286) are able to deflect inwardly substantially about a longitudinal axis upon experiencing a weight concentration on a more interior portion thereof.

The pommel 290 is completely separable from the U-shaped perimeter section 274, and when assembled defines the forward central portion of the base 270. In this regard, the pommel 290 primarily interfaces with the user's legs such that it includes a center ridge 294 to provide for a separation for the user's legs. Moreover, the pommel 290 includes anatomically-contoured, slightly concave, leg cavities 304. In order to provide for further adaptability of the base 270 to the needs and the support characteristics of the user, two pommel leg sections 298 which also have a generally concave upper surface may be detachably connected within the leg cavities 304 of the pommel 290 via velcro connectors 299. Each of these pommel leg sections 298 may assume a variety of lateral and longitudinal positions on the pommel 290 within the leg cavities 304 to achieve desired objectives. Further adaptability may be achieved by positioning pommel flow packs 300 (e.g., fluid-containing pads having the above-described type of flowable material therein) on the upper surface of one or more of the pommel leg sections 298 and detachably connecting such thereto via velcro connectors 302.

A primary feature of the base 270 which is not incorporated into either of the bases 30 and 150 discussed above is that the pommel 290 is separable from the U-shaped perimeter section 274 of the base 270. As such, the longitudinal position of the pommel 290 may be varied in relation to the distance from the back section 278. As such, the base 270 includes a pommel longitudinal connection assembly which includes a plurality of velcro strips 312 positioned on the interfacing surfaces of the pommel 290 (not shown) and side sections 282. This fore and aft adjustment of the pommel 290 relative to the back section 278 of the base 280 may be used, for instance, to reduce a loading in the ischial area of a particular user. That is, by engaging the legs of a user with the pommel 290 in a more rearedly disposed location, the weight of the user forward of the pommel 290 may be used to effectively raise the ischial region of the user. Generally, positioning the pommel 290 more rearwardly within the base 270 increases the length of the moment arm and thus allows for a more effective utilization of this weight to elevate the ischial region of the user to reduce pressure concentrations thereon.

The base 270 also includes further support characteristic adjustment features which are not incorporated into either of the bases 30, 150 discussed above, and which relate to the separability of the pommel 290 from remaining portions of the base 270. By moving the side sections 282 of the U-shaped perimeter section 274 inwardly toward each other or outwardly away from each other, the vertical extent of the upper surface of the pommel 290 when positioned thereon may be adjusted. That is, when the ends of the side sections 282 are positioned closer to each other and when the pommel 290 is positioned thereon and secured thereto via the strips 312 and interacting strips on the lower surface of the side portions of the pommel 290 (not shown), the pommel 290 will assume a first vertical height. When the ends of the side sections 282 are forced away from each other and the pommel 290 is detachably connected thereto in the noted manner, the upper surface of the pommel 290 will be disposed at a second vertical height which is less than the first vertical height. This adjustability of the vertical position of the pommel 290 may be realized by having the interfacing surfaces of the pommel 290 and the side sections 282 being chamfered or angled (illustrated for the side sections 282). Consequently, not only is the longitudinal position of the pommel 290 adjustable, but so is its vertical position which provides for further variation of the support characteristics of the base 270.

An additional support altering characteristic of the system 250 is that side cavities 324 are disposed in the aft portion of each of the side sections 282 and adjacent portions of the back section 278 of the base 270. With these side cavities 324, the base 270 is able to pivot or deflect in an outwardly direction with reduced resistance since no material of the base 270 is compressed in the region coinciding with the side cavities 324. In order to provide for further variability of the support characteristics of the system 250, these side cavities 324 may each receive a removable support 328. The size and/or the compressibility of the supports 328 may be varied, which in turn will vary the support characteristics of the system 250.

As noted above, the system 250 includes a pad 254 which is disposed over the upper surface of the base 270. As in the above-described embodiments, the pad 254 is designed to reduce the potential for any hammocking of the user when positioned thereon and to further reduce wrinkling of the pad 254 in the installed position. The pad 254 includes a generally crescent-shaped back section 254 which interfaces primarily with the upper surface of the perimeter section 274 of the base 270, a generally V-shaped front section 262 which interfaces primarily with the pommel 290, and an intermediate section 266 which is positioned therebetween and coincides with the oval-shaped cavity 288. When installed, the crescent-shaped back section 258 is substantially isolated from the V-shaped front section 262 since the pad 254 is folded over upon itself in the intermediate section 266 Which thereby forms a flow-barrier. As such, the pad 254 could actually be formed in two separate pieces.

As in the above-described embodiments, the system 250 has improved force distribution characteristics, and thus reduces unit pressure experienced by the user due to the substantial matching of the profile of the base 270 with the interfacing surfaces of the user. This also again allows for a weight reduction for the system 250. In this regard, the weight of the system 250 may be within the above-noted ranges.

Figure 24A:
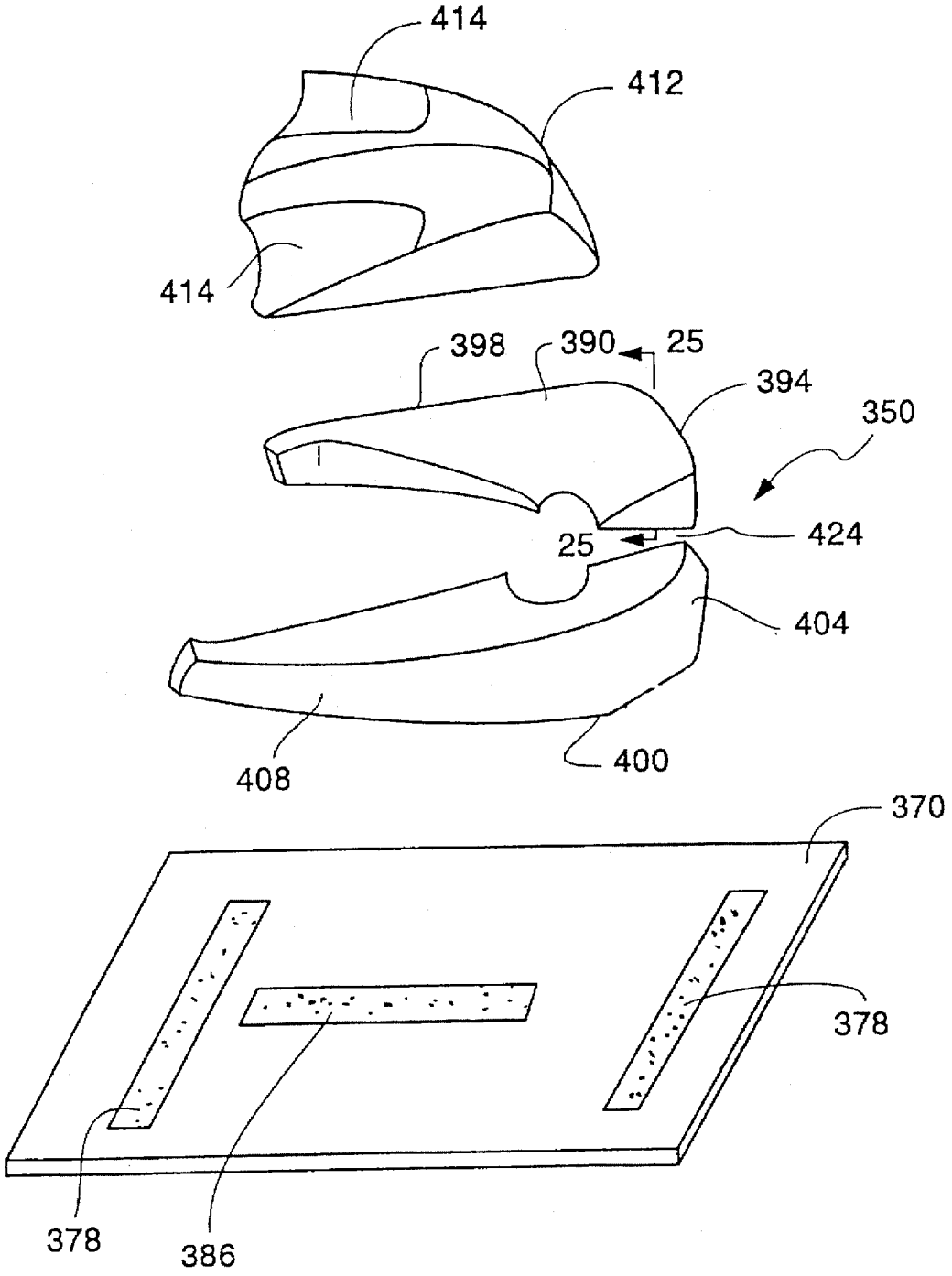
FIG. 24A is an exploded perspective view of another embodiment of a base for a wheelchair seat cushion system.
Figure 24B:
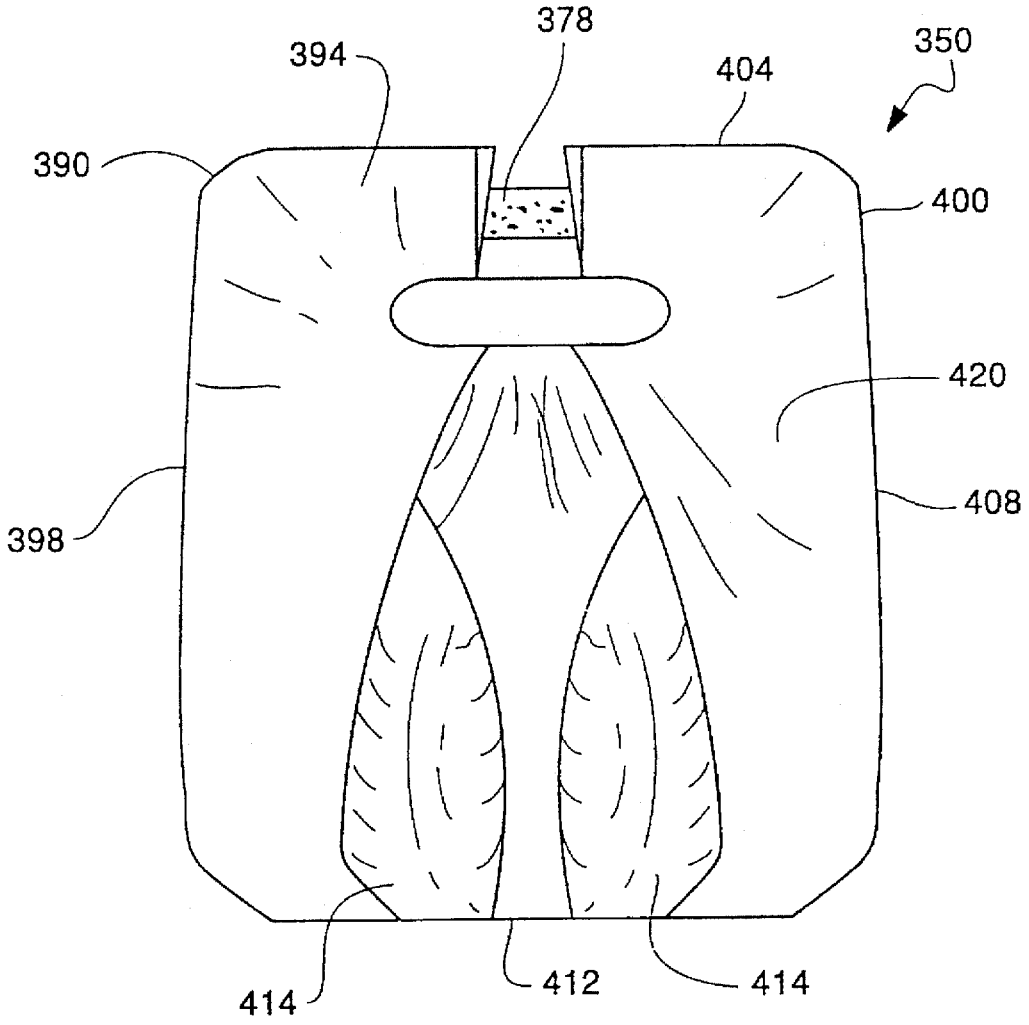
FIG. 24B is a top view of the system of FIG. 24A.
Figure 25:
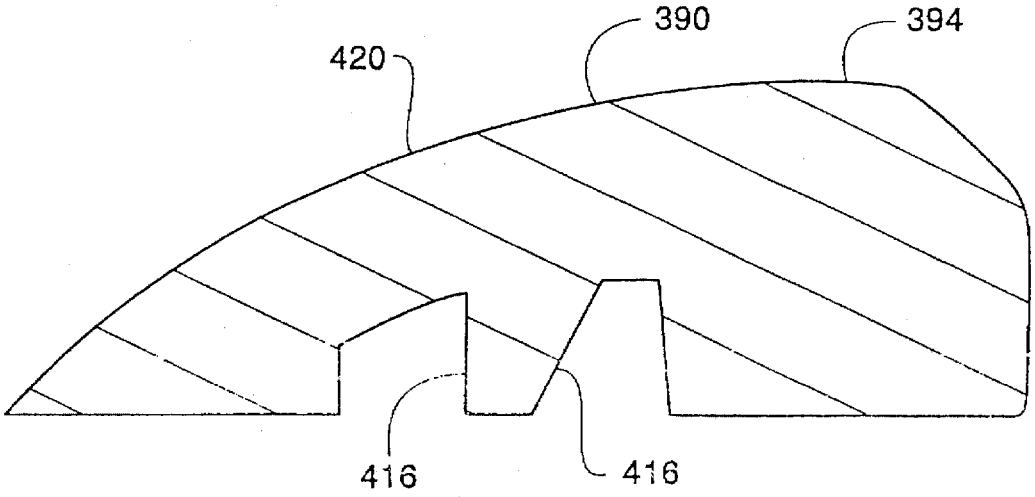
FIG. 25 is a cross-sectional view of the base of FIG. 24A taken along line 25—25.
Figure 26:
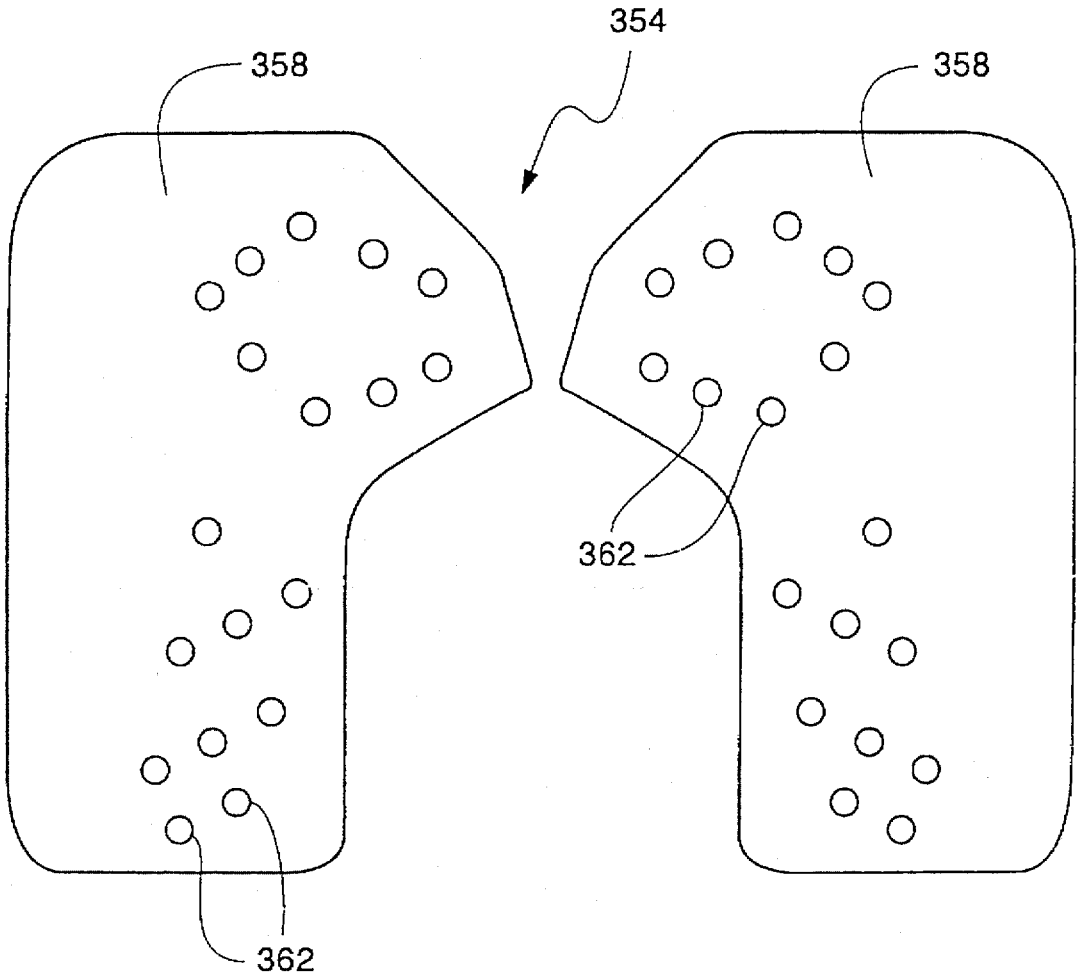
FIG. 26 is a top view of a padding system for the base of FIG. 24A.

Another embodiment of a wheelchair seat cushion system is disclosed in FIGS. 24–26. The system 350 is similar to those described above in that it has a pad assembly 34 positioned on a rigid yet flexible base 366. Furthermore, the base upper surface 420 is again anatomically contoured. However, in contrast to the foregoing embodiments, the base 366 is formed from three separate structures to provide for further adjustability of the dimensions of the base 366. In this regard, the base 366 is mounted on a platform 370 via appropriately two laterally extending velcro connectors 378 and one longitudinally extending velcro connector 386 positioned on the platform 370 and which interface with similar velcro connectors (not shown) positioned on the lower surface of the base 366. The platform 370 may be formed from materials such as ABS, high-density polyethylene, and other similar plastic strapping materials.

The base 366 is formed from materials of the above-described type and generally includes an anatomically contoured first section 390 having an integrally formed back 394 and side 398, as well as an integrally formed second section 400 having a back 404 and integrally formed side 408. An anatomically contoured pommel 412 is detachably connectable to the sides 398, 408, as well as the platform 370. As such, the longitudinal position of the pommel 412 may be adjusted in the manner discussed above with regard to the pommel 290. Moreover, the lateral position of each of the left and right sections 390, 400 may be independently adjusted, for instance to vary the width of the opening at the back of the base 366, as well as the width between the forward portions of the sides 398, 408.

As in the above-described embodiments, the pad assembly 354 includes a fluid, preferably a flowable material, and such is positioned on the upper surface of the base 366. In this case, the pad assembly 354 includes two separate pad sections 358 which each generally approximate the contour of the corresponding portion of the base 366 which reduces wrinkling of the sections 358 and also allows for the use of less flowable material which provides for weight reduction. Moreover, the pad sections 354 each include a plurality of circular flow barriers (e.g., by fixing the upper surface of the pad sections 354 to the lower surface thereof).

The foregoing description of the invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended the claims be construed to include alternative embodiments to the extent permitted by the prior art.

What is claimed is:

1. An anatomical wheelchair seat cushion system, comprising:

a flexible base comprising a central, longitudinal axis, a generally laterally extending back, two laterally displaced sides which extend at least forward from said back, and a front pommel longitudinally displaced from said back and interconnected with each of said two laterally displaced sides, wherein at least said back, said two laterally displaced sides, and said pommel collectively define an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, said base further comprising a lower surface which interfaces with a wheelchair seat, wherein less than about 70% of said lower surface of said base interfaces with the wheelchair seat when disposed thereon to provide for at least a predetermined flexure of said base when a user is disposed thereon; and a pad positioned over an upper surface of said base.

2. A system, as claimed in claim 1, wherein:

said back of said base comprises a substantially laterally extending centrally positioned opening.

3. A system, as claimed in claim 2, wherein:

said opening is a substantially V-shaped notch extending for only a part of a vertical extent of said back.

4. A system, as claimed in claim 2, wherein:

said opening extends through an entire vertical extent of said back and separates said back into substantially equalized first and second back sections.

5. A system, as claimed in claim 4, wherein:

said first and second back sections are interconnected by a first member, said system further comprising a lateral connection assembly between each of said first and second back sections and said first member which accommodates for a variety of lateral positions of each of said first and second back sections.

6. A system, as claimed in claim 5, wherein:

said first member comprises an engaging surface for detachably and fixedly engaging each of said first and second back sections.

7. A system, as claimed in claim 4, wherein:

a width of said opening is adjustable.

8. A system, as claimed in claim 1, wherein:

said upper surface defined by said back is inclined relative to horizontal at an angle of approximately 25 degrees.

9. A system, as claimed in claim 1, wherein:

said upper surfaces defining said back, said aft portions of said sides, and said aft portion of said pommel collectively define a substantially frustumly-shaped surface.

10. A system, as claimed in claim 1, wherein:

said base comprises an opening which extends vertically through said base, said opening being sized to be positioned vertically below ischial tuberosities of the user.

11. A system, as claimed in claim 1, further comprising:

a generally U-shaped opening extending entirely through said base which separates said base from said pommel and each of said sides from said aft portion of said pommel.

12. A system, as claimed in claim 1, wherein:

said pommel is cantileveredly connected with foreword portions of said sides of said base.

13. A system, as claimed in claim 1, wherein:

said laterally extending back comprises first and second back sections, each being interconnected with one of said sides, said system further comprising means for adjusting a spacing between said first and second back sections.

14. A system, as claimed in claim 1, further comprising:

means for providing a plurality of contours of said upper surface of said base for the user.

15. A system, as claimed in claim 1, wherein:

said laterally extending back comprises first and second back sections each being interconnected with one of said sides, said system further comprising means for pivoting said first back section and said interconnected side substantially about a first predefined longitudinal axis and means for pivoting said second back section and said interconnected side substantially about a second predefined longitudinal axis laterally displaced from said first predefined longitudinal axis.

16. A system, as claimed in claim 1, further comprising:

means for pivoting said pommel substantially about a lateral-axis.

17. A system as claimed in claim 1, wherein:

said lower surface comprises at least one ventilation channel.

18. A system, as claimed in claim 1, wherein:

said lower surface comprises first, second and third ventilation channels which each generally extend from a forward portion of said base toward a rear portion of said base.

19. A system, as claimed in claim 18, wherein:

said second ventilation channel is positioned between said first and third ventilation channels, said first and second ventilation channels converging toward a central, longitudinal axis of said base.

20. A system, as claimed in claim 1, wherein:

said lower surface comprises a first generally longitudinally extending side rail under one of said sides of said base and a second generally longitudinally extending side rail under the other of said sides of said base.

21. A system, as claimed in claim 20, wherein:

said first and second side rails provide for a supported pivoting of a first back section and an adjacent said side of said base and a second back section and an adjacent said side of said base, respectively.

22. A system, as claimed in claim 20, wherein:

each of said first and second side rails comprise a bottom surface and first and second side surfaces, said first and second side surfaces extending from said bottom surface divergently away from a central, longitudinal axis of said corresponding channel.

23. A system, as claimed in claim 22, wherein:

said first and second side surfaces of each of said side rails are generally linear.

24. A system as claimed in claim 20, further comprising:

first and second laterally-extending channels which separate said first and second rails, respectively, into forward and aft rail sections.

25. A system, as claimed in claim 24, wherein:

said first and second laterally-extending channels provide a lateral axis about which forward and aft sections of said base may pivot.

26. A system, as claimed in claim 1, wherein:

said lower surface comprises first and second laterally displaced and generally longitudinally extending pommel rails positioned below said pommel and displaced inwardly from said sides.

27. A system, as claimed in claim 26, wherein:

said first and second pommel rails allow for a supported pivoting of first and second lateral sections, respectively, of said pommel about said first and second pommel rails, respectively.

28. A system, as claimed in claim 1, further comprising:

means for removably interconnecting said base and said, pad.

29. A system, as claimed in claim 1, further comprising:

a plurality of velcro connectors on said upper surface of said base and a plurality opposing velcro connectors on a lower surface of said pad.

30. A system, as claimed in claim 1, wherein:

said pad comprises means for positioning said pad on said upper surface of said base in a substantially wrinkle-free condition.

31. A system, as claimed in claim 1, wherein:

said pad comprises first and second lateral and separate pad sections, wherein a position of each of said first and second pad sections is adjustable relative to the other of said first and second pad sections.

32. A system, as claimed in claim 1, wherein:

said pad comprises a back pad section which interfaces with said upper surface of said back of said base.

33. A system, as claimed in claim 32, wherein:

said pad comprises a fluid and said back pad section comprises means for restricting flow within said back pad section.

34. A system, as claimed in claim 32, wherein:

said pad comprises a fluid and said back pad section comprises a plurality of segments formed by joining an upper surface of said pad to a lower surface of said pad.

35. A system, as claimed in claim 1, wherein:

a thickness of said pad is between about ¼ inch and about 2 inches.

36. A system, as claimed in claim 1, wherein:

a weight of said pad is between about ¼ pound and about 2 pounds.

37. A system, as claimed in claim 1, wherein:

a weight of said system is between about 3 pounds and about 6 pounds.

38. A system as claimed in claim 1, wherein:

said base is integrally formed whereby said back, said two side portions, and said pommel are of a one-piece construction, wherein said back has an arcuate extent in a horizontal reference plane which is generally parallel with a portion of said lower surface of said base which interfaces with the wheelchair seat when said base is disposed thereon, has a back rim which defines an uppermost portion of said back, and has a back engaging surface which extends downwardly from said back rim at an angle toward a first reference location on said base which is longitudinally spaced from said back rim, wherein each of said two laterally displaced side portions comprise a side rim which defines an uppermost portion of said side portions and an aft side engaging surface which extends downwardly from said side rim at an angle toward said first reference location on said base which is disposed inwardly of each of said side rims in a direction of said central, longitudinal axis, and wherein said pommel comprises an aft pommel engaging surface which extends downwardly at an angle from an adjacent portion of said pommel toward said first reference location of said base which is longitudinally displaced from said adjacent portion of said pommel, wherein said back engaging surface, said aft side engaging surfaces of said two laterally displaced side portions, and said pommel engaging surface collectively define a bowl-shaped configuration for said concave receiving area.

39. A system as claimed in claim 38, wherein:

said back comprises an angulated back engaging surface, wherein said back engaging surface is disposed at a first angle at a first radial position relative to said central, longitudinal axis, wherein said back engaging surface is disposed at a second angle at a second radial position relative to said central, longitudinal axis, and wherein said back engaging surface is disposed at a third angle at a third radial position relative to said central, longitudinal axis, wherein said second angle is of a smaller magnitude than a magnitude of each of said first and third angles.

40. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said back of said base comprises a substantially laterally extending, centrally positioned opening, wherein said opening extends through an entire vertical extent of said back and separates said back into substantially equal-sized first and second back sections, and wherein said first and second back sections are interconnected by a first member, said system further comprising a lateral connection assembly between each of said first and second back sections and said first member which accommodates for a variety of lateral positions of each of said first and second back sections; and a pad positioned over an upper surface of said base.

41. A system, as claimed in claim 40, wherein:

wherein said first member comprises an engaging surface for detachably and fixedly engaging each of said first and second back sections.

42. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said back of said base comprises a substantially laterally extending, centrally positioned opening, wherein said opening extends through an entire vertical extent of said back and separates said back into substantially equal-sized first and second back sections, and wherein a width of said opening is adjustable; and a pad positioned over an upper surface of said base.

43. An anatomical wheelchair seat cushion system, comprising;

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, and wherein said base further comprises a generally U-shaped opening extending entirely through said base which separates said base from said pommel and each of said sides from said aft portion of said pommel; and a pad positioned over an upper surface of said base.

44. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said pommel is cantileveredly connected with foreword portions of said sides of said base; and a pad positioned over an upper surface of said base.

45. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said base comprises a lower surface which interfaces with a support structure, and wherein said lower surface comprises at least one ventilation channel; and a pad positioned over an upper surface of said base.

46. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said base comprises a lower surface which interfaces with a support structure, and wherein said lower surface comprises first, second and third ventilation channels which each generally extend from a forward portion of said base toward a rear portion of said base; and a pad positioned over an upper surface of said base.

47. A system, as claimed in claim 46, wherein:

said second ventilation channel is positioned between said first and third ventilation channels, said first and second ventilation channels converging toward a central, longitudinal axis of said base.

48. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said base comprises a lower surface which interfaces with a support structure, wherein said lower surface comprises a first generally longitudinally extending side rail under one of said sides of said base and a second generally longitudinally extending side rail under the other of said sides of said base, wherein said first and second side rails provide for a supported pivoting of a first back section and an adjacent said side of said base and a second back section and an adjacent said side of said base, respectively; and a pad positioned over an upper surface of said base.

49. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said base-comprises a lower surface which interfaces with a support structure, wherein said lower surface comprises a first generally longitudinally extending side rail under one of said sides of said base and a second generally longitudinally extending side rail under the other of said sides of said base wherein each of said first and second side rails comprise a bottom surface and first and second side surfaces, said first and second side surfaces extending from said bottom surface divergently away from a central, longitudinal axis of said corresponding channel; and a pad positioned over an upper surface of said base.

50. A system, as claimed in claim 49, wherein:

said first and second side surfaces of each of said side rails are generally linear.

51. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said base comprises a lower surface which interfaces with a support structure, wherein said lower surface comprises a first generally longitudinally extending side rail under one of said sides of said base and a second generally longitudinally extending side rail under the other of said sides of said base, and wherein said lower surface further comprises first and second laterally-extending channels which separate said first and second rails, respectively, into forward and aft rail sections; and a pad positioned over an upper surface of said base.

52. A system, as claimed in claim 51, wherein:

said first and second laterally-extending channels provide a lateral axis about which forward and aft sections of said base may pivot.

53. An anatomical wheelchair seat cushion system, comprising:

a flexible base comprising a back, two laterally displaced sides and a front pommel defining an upper surface for interfacing with a user, wherein said upper surface of said base defined by said back, an aft portion of each of said two sides, and an aft portion of said pommel each taper downwardly and inwardly toward an interior portion of said base to collectively define a generally concave receiving area for the user, and wherein said upper surface defined by said back and said sides are each anatomically-shaped to substantially approximate a coincident portion of an anatomical structure of the user, wherein said base comprises a lower surface which interfaces with a support structure, wherein said lower surface comprises first and second laterally displaced and generally longitudinally extending pommel rails positioned below said pommel and displaced inwardly from said sides; and a pad positioned over an upper surface of said base.

54. A system, as claimed in claim 53, wherein:

wherein said first and second pommel rails allow of a supported pivoting of first and second lateral sections, respectively, of said pommel about said first and second pommel rails, respectively.

55. A seat cushion system, comprising:

a flexible base comprising a central, longitudinal axis, a generally laterally extending back, two laterally displaced sides which extend forward from said back, and a front pommel longitudinally displaced from said back and interconnected with each of said two laterally displaced sides, wherein at least said back, said two laterally displaced sides, and said pommel collectively define an upper surface for interfacing with a user, and wherein said upper surface of said base defined by said back, an aft portion of each of said two sides, and an aft portion of said pommel each taper downwardly and inwardly toward an interior portion of said base to collectively define a generally concave receiving area for the user, said base further comprising a lower surface which interfaces with a support structure, said lower surface comprising first and second portions, said first portion being substantially contained within a first reference plane and interfacing with said support structure, said second portion being displaced above said first reference plane in a direction of said upper surface of said base, wherein an area of said first portion is less than about 70% of an area of a portion of said first reference plane having dimensions of said base.

* * * * *